US012644467B2

(12) United States Patent
Burns et al.

(10) Patent No.: US 12,644,467 B2
(45) Date of Patent: Jun. 2, 2026

(54) SPRING PUSH BLADE IRON LOCK

(71) Applicant: HKC-US, LLC, Memphis, TN (US)

(72) Inventors: James Burns, Memphis, TN (US); Brendan Byrne, Germantown, TN (US); Jeff Newman, Cornelius, NC (US)

(73) Assignee: HKC-US, LLC, Memphis, TN (US)

( * ) Notice: Subject to any disclaimer, the term of this patent is extended or adjusted under 35 U.S.C. 154(b) by 0 days.

(21) Appl. No.: 19/301,499

(22) Filed: Aug. 15, 2025

(65) Prior Publication Data

US 2026/0049617 A1 Feb. 19, 2026

Related U.S. Application Data

(60) Provisional application No. 63/683,930, filed on Aug. 16, 2024.

(51) Int. Cl.
*F04D 29/34* (2006.01)
*F04D 25/08* (2006.01)

(52) U.S. Cl.
CPC ..... *F04D 29/34* (2013.01); *F04D 25/088* (2013.01)

(58) Field of Classification Search
CPC ..... F04D 25/088; F04D 29/34
See application file for complete search history.

(56) References Cited

U.S. PATENT DOCUMENTS 5,951,197 A 9/1999 Wu
5,954,449 A 9/1999 Wu
6,042,339 A 3/2000 Blateri
6,059,531 A * 5/2000 Tai ..... F04D 29/34 416/207
6,241,475 B1 6/2001 Blateri
6,692,233 B2 * 2/2004 Liang ..... F04D 29/34 416/220 A
6,719,531 B2 * 4/2004 Wu ..... F04D 29/34 403/324
6,726,453 B1 * 4/2004 Hsieh ..... F04D 25/088 416/207

(Continued)

*Primary Examiner* — Sang K Kim

(74) *Attorney, Agent, or Firm* — Brian S. Steinberger; Hilary F. Steinberger; Steinberger IP Law

(57) ABSTRACT

Systems, devices, and methods for an easy to a dual latch system that work simultaneously for locking a blade iron part of a ceiling fan blade to a motor-rotor housing. A first mechanism includes a protruding catch end with a vertical slot through the blade iron. The protruding end of the blade arm is pushed against a spring biased ledge member in the motor-rotor fan housing and when the blade iron is moved downward the protruding catch end hooks about an upwardly raised member inside the motor housing, and when the spring pushes the ledge member outward locks the blade in place with the first mechanism. The second mechanism includes a spring biased latch member with angled face under the first mechanism. A fixed protrusion under the blade iron in the direction of the motor-rotor housing forms a gap between the blade iron and the tab. When the protruding catch end of the blade iron is moved downward, the latch member is pushed outward by the spring and the angled front face of the spring-based latch member is directed into the gap, actuating the second latch mechanism.

12 Claims, 22 Drawing Sheets

(56) References Cited

U.S. PATENT DOCUMENTS

| | | | | |
|---|---|---|---|---|
| 7,008,192 | B2 * | 3/2006 | Hidalgo | F04D 29/34 416/220 A |
| 9,453,517 | B1 | 9/2016 | Burns et al. | |
| 9,631,626 | B1 | 4/2017 | Byrne | |
| 9,651,058 | B1 | 5/2017 | Mares | |
| 12,180,973 | B1 * | 12/2024 | Chen | F04D 25/088 |
| 12,203,478 | B1 * | 1/2025 | Guo | F04D 29/34 |
| 12,234,833 | B2 * | 2/2025 | Botkin | F04D 19/002 |
| 12,264,686 | B1 * | 4/2025 | Botkin | F04D 29/34 |
| 2009/0175728 | A1 | 7/2009 | DeLeon | |
| 2012/0034085 | A1 | 2/2012 | Lagman | |
| 2023/0111026 | A1 * | 4/2023 | Wang | F04D 29/34 416/210 R |

* cited by examiner

SPRING PUSH BLADE IRON LOCK

CROSS REFERENCE TO RELATED APPLICATIONS

This application claims the benefit of priority to U.S. Provisional Application Ser. No. 63/683,930 filed Aug. 16, 2024, which is incorporated herein by specific reference thereto.

FIELD OF INVENTION

This invention relates to ceiling fans, and in particular to a push spring ceiling fan blade and lock attachment system, device and method.

BACKGROUND AND PRIOR ART

Blade arms typically mount to motor housings by screwing the ends of the blade arms to the rotor portion of the motor housing. Examples of the traditional screwing the ends of the blade arms to the rotor portion are shown and described in U.S. Pat. No. 5,954,449 to Wu, and U.S. Published Patent Applications: 2009/0175728 to De Leon and 2012/0034085 to Lagman et al, which are incorporated by reference in their entirety. These types of assembly take time to accomplish and can be quite tedious and difficult to accomplish.

Modifications to secure blade arms to rotors have included forming curved end connectors on the blade arm which can be slid into pairs of slots adjacent to the fan motor housing. See for example, U.S. Pat. No. 5,951,197 to Wu; U.S. Pat. No. 6,042,339 to Blateri et al. and U.S. Pat. No. 6,241,475 to Blateri et al., which are incorporated by reference in their entirety. However, these attempts require the assembler having to align each of the ends into each corresponding slot on the motor, which can be quite tedious and difficult to accomplish. in a ceiling mounted fan motor.

Pushing and turning an end of a blade arm mounted to a blade has been used to mount the blade arm with blade to the motor. See for example, U.S. Pat. No. 9,651,058. However, this approach also requires the assembler having to align up a unique shaped end of the blade arm to fit into a mateable side slot in the motor housing, which can also be quite tedious and difficult to accomplish in a ceiling mounted fan motor.

Thus, the need exists for solutions to the above problems with the prior art.

SUMMARY OF THE INVENTION

A primary objective of the present invention is to provide systems, devices, and methods easily assembling blade irons to motor-rotor housing rotor with dual spring biased latch mechanisms that do not require tools for the assembly.

A primary objective of the present invention is to provide systems, devices, and methods easily assembling blade irons to motor-rotor housing rotor with two latch mechanisms that work simultaneously for locking a blade iron part of a ceiling fan blade to a motor-rotor housing.

A third objective of the present invention is to provide systems, devices, and methods an easy to attach ceiling blade with a protruding end and a catch, wherein the protruding end pushes against a horizontal spring biased member in a motor/rotor bracket and when the blade is moved downward the catch end hooks over a curb edge inside the motor housing, and the spring pushes the horizontal spring based member outward locking the blade in place.

An embodiment includes a two-latch mechanism system, with two latch mechanism that work simultaneously for locking a blade iron part of a ceiling fan blade to a motor-rotor housing.

A first latch mechanism includes a side protruding end of a blade iron that pushes against a spring biased ledge member in a motor-rotor fan housing which exposes an L-shaped cavity underneath. The side protruding end of the blade arm is moved downward and hooks within the L-shaped cavity. The released ledge member is pushed outward covering the side protruding end in the L-shaped cavity that actuates the first latch mechanism to attach the blade arm to the motor-rotor fan housing.

A second latch mechanism includes a spring biased latch member is under the L-shaped cavity, the latch member having an angled front face in the direction of the blade arm. The spring biased latch member is pushed inward inside the motor-rotor housing. A fixed tab under the blade iron in the direction of the motor-rotor housing forms a gap between the blade iron and the tab. When the side protruding end of the blade iron is moved downward, the latch member is pushed outward by the spring and the angled front face of the latch member is directed into the gap, actuating the second latch mechanism.

Actuating both the first latch mechanism and the second latch mechanism locks the blade iron to the motor-rotor housing.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

DESCRIPTION OF THE PREFERRED EMBODIMENTS

Figure 1A:
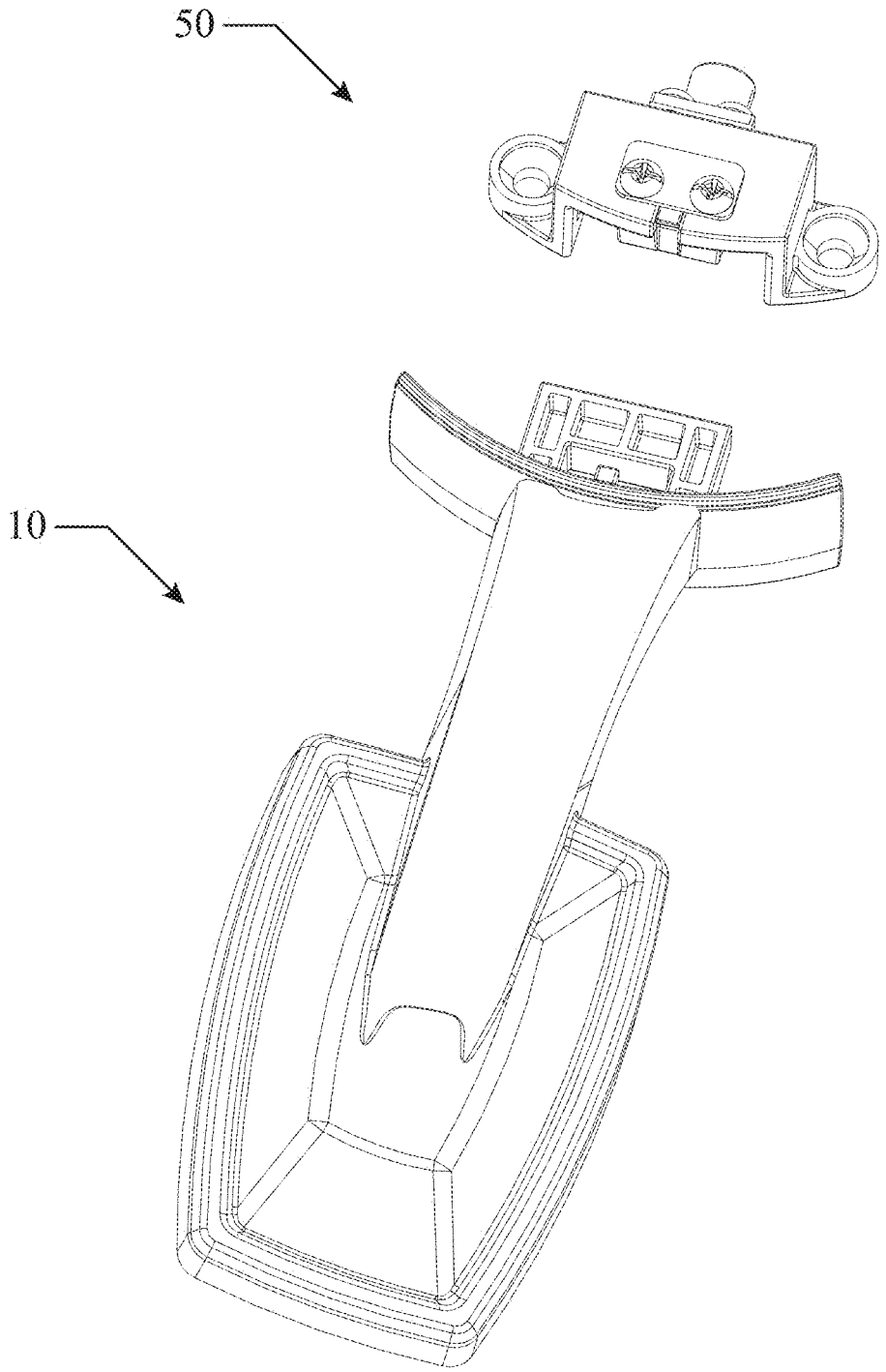
FIG. 1A is a top perspective view of the novel ceiling fan blade arm separated from the novel assembled receiver bracket used in the invention.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

A list of components will now be described.

10 blade arm/iron formed from one machined piece of metal, and/or one piece of molded plastic
12 blade mounting end
14 posts in blade mounting end for inserting into through holes on inner end of a ceiling fan blade
20 motor mount end of blade arm
22 curved flange member
24 fixed protruding stud
30 protruding rectangular member
32 closed sides
34 top
35 T-shaped cutout

36 bottom
37 T-shaped cutout
38 skeletal cut-outs to reduce weight and density
50 assembled receiver bracket
51 exploded view of receiver bracket
60 receiver box
61 first side mounting tab for screw/bolt to fasten to base of motor/rotor.
62 slit opening in receiver box to chamber to receive slidable horizontal table/panel therein.
63 second side mounting tab for screw/bolt to fasten to base/bottom of motor/rotor.
64 outer wall
65 slideable horizontal table/panel/ledge member
66 screw holes for mounting cap cover thereto
67 main spring to bias against slidable horizontal table/panel
70 top side of receiver box
72 vertical top opening to receive spring biased moveable enlarged head catch member stud with wedge shaped front end
74 enlarged head catch member stud with wedge shaped front end (spring biased latch member
76 small spring which biases against enlarged head catch member stud with wedge shaped front end
77 threaded openings in top side of receiver box
78 cover plate
79 screws to fasten cover plate to top side of receiver box
80 cap cover for main spring 67
82 closed one end hollow cylinder to open end to receive main spring
84 mounting tab with through-holes.
85 screws to fasten mounting tab of cap cover to screw holes on outer wall
90 raised latch compartment/latch member inside rectangular/receiver box 60
100 Ceiling fan motor with ceiling mount
110 exposed lower plate base/bottom of motor/rotor with
115 mounting holes for assembled receivers
120 ceiling fan blade
150 light kit The novel invention uses novel assembled receiver boxes 50 that are mounted underneath to a lower surface of a motor housing to form the rotating rotor portion of the motor. The invention includes novel ceiling fan blade arms/irons 10 having one end attached to ceiling fan blades, and an opposite end having a novel rectangular protruding member extending from a curved plate. During assembly of the ceiling fan, the rectangular protruding member on the blade arm is pushed into a side slit opening of the assembled receiver box, and pushed against a spring biased table member and pulled vertically so it latches with the receiver box, as will be explained below.

Figure 1B:
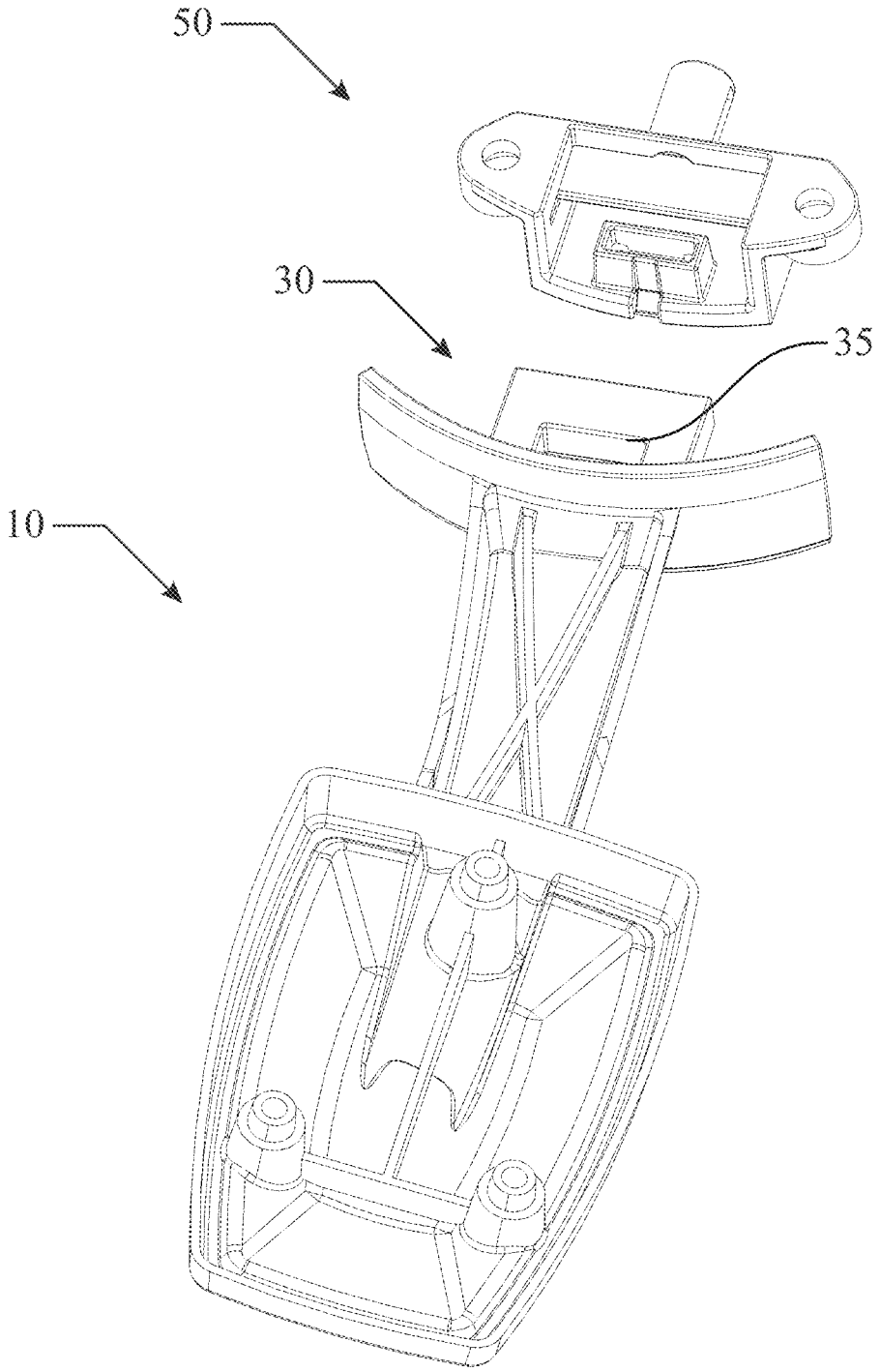
FIG. 1B is a lower perspective view of the novel ceiling fan blade arm separated from the novel assembled receiver bracket of FIG. 1A.

FIG. 1A is a top perspective view of the novel ceiling fan blade arm 10 separated from the novel assembled receiver bracket 50 used in the invention. FIG. 1B is a lower perspective view of the novel ceiling fan blade arm 10 separated from the novel assembled receiver bracket 50 of FIG. 1A.

Figure 2A:
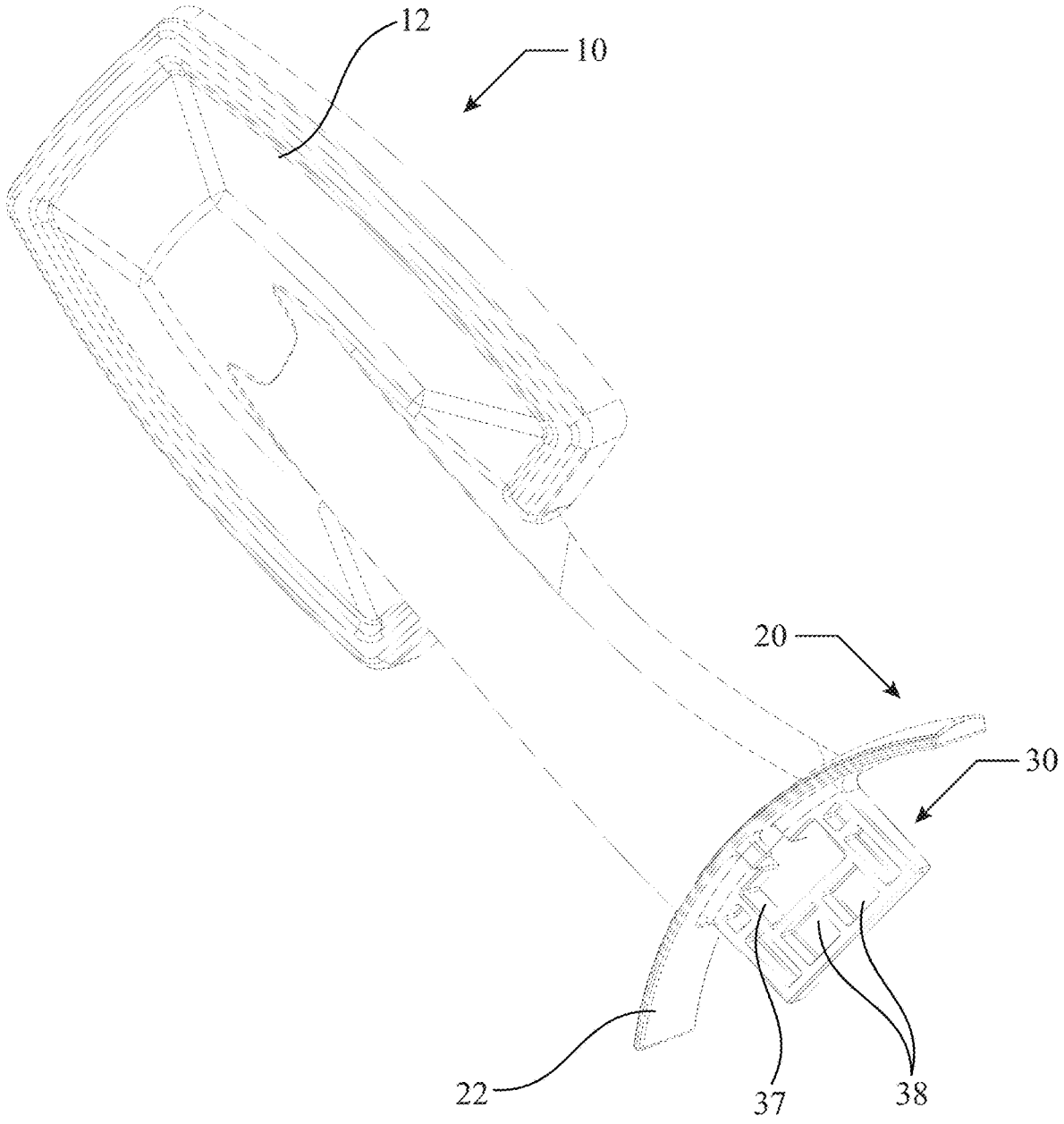
FIG. 2A is a top perspective view of the fan blade arm of FIG. 1A and FIG. 1B.
Figure 2B:
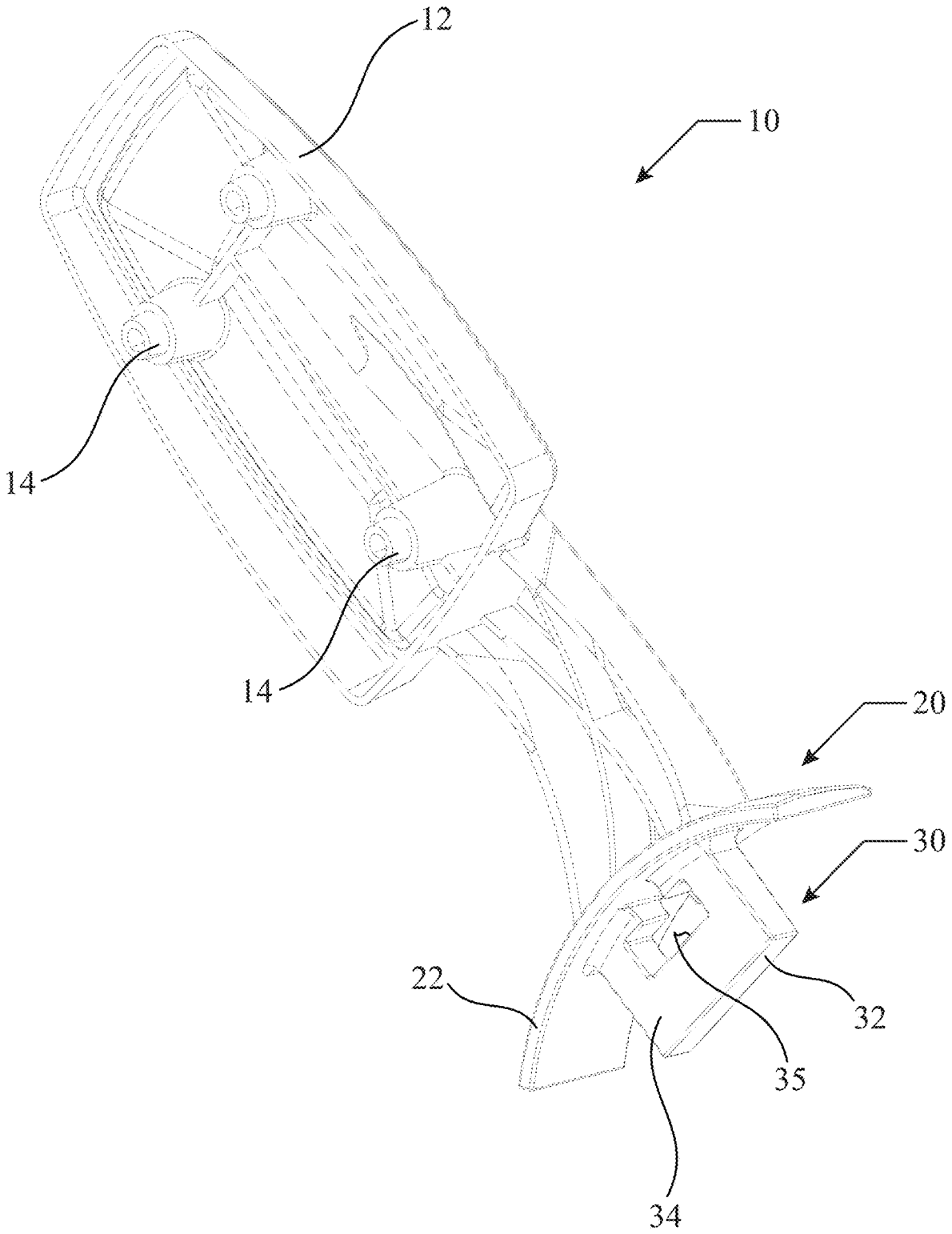
FIG. 2B is a lower perspective view of the fan blade arm of FIG. 2A.
Figure 2C:
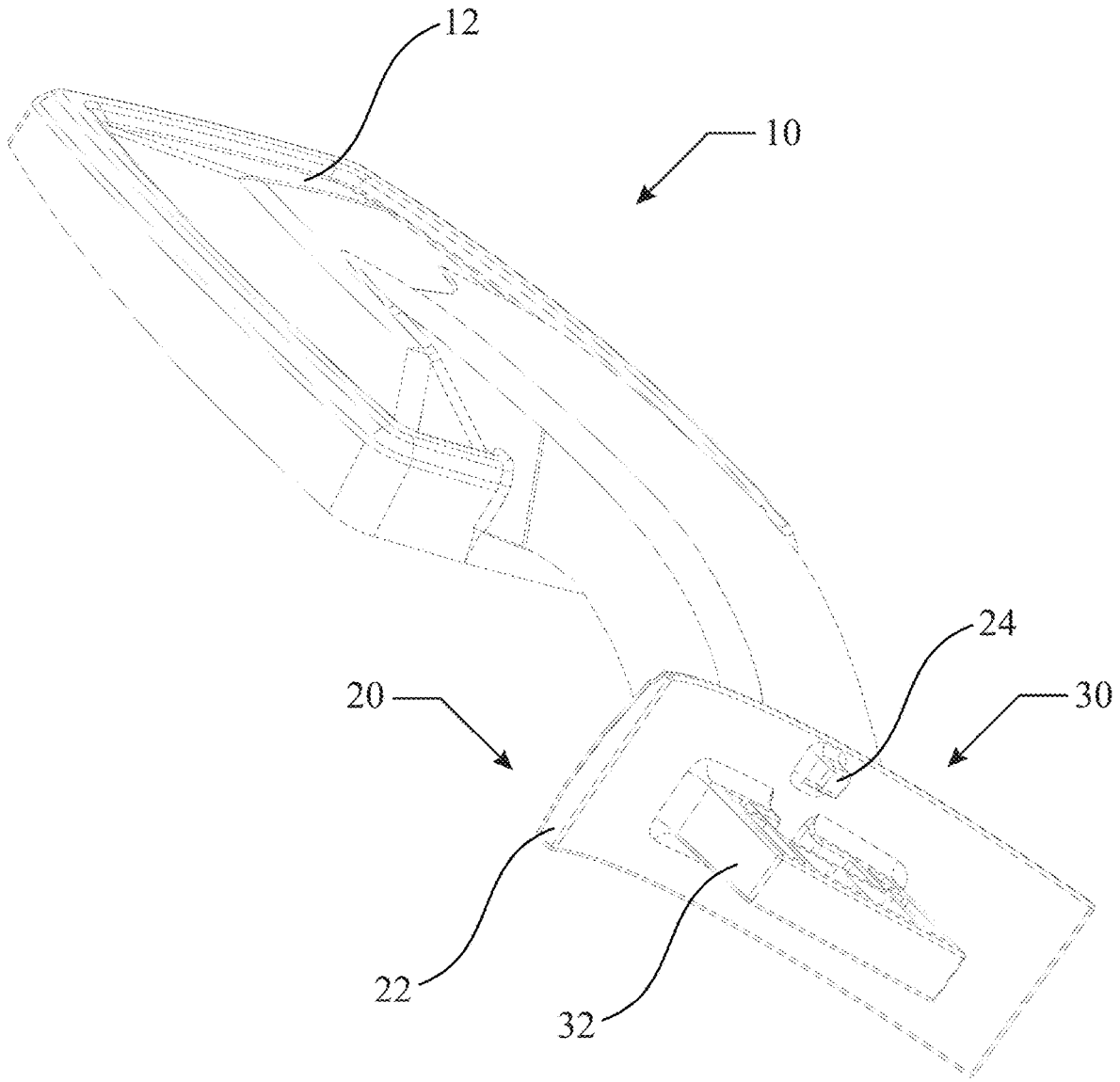
FIG. 2C is a rear upper left side view of the blade arm of FIG. 2A.

FIG. 2A is a top perspective view of the fan blade arm 10 of FIG. 1A and FIG. 1B. FIG. 2B is a lower perspective view of the fan blade arm 10 of FIG. 2A. FIG. 2C is a rear upper left side view of the blade arm 10 of FIG. 2A.

Referring to FIGS. 1A-2C, the blade arm 10 can have a blade mounting end 12 with one side having a plurality of posts 14 that can be used for securing fan blades thereto, such as those shown in U.S. Pat. No. 5,951,197 to Wu; U.S. Pat. No. 6,042,339 to Blateri et al. U.S. Pat. No. 6,241,475 to Blateri et al. which are incorporated by reference in their entirety.

The blade arm 10 can have a motor mount end 20 for attaching the blade arm to a motor/rotor on a ceiling fan. The motor mount end 120 can have a curved flange member 22, with a protruding rectangular member 30 extending therefrom with a fixed protruding stud 30 extending from the curved flange member 22 above the protruding rectangular member 30.

The protruding rectangular member 30 can have closed sides 32 and a top 34 with a T-shaped cut-out opening 35 which passes to a bottom 36 with its T-shaped cutout 37. On the top 34 can be skeletal cut-outs 38 that are used to reduce weight and density of the protruding member 30.

The entire ceiling fan blade arm/iron can be formed/machined from one piece of material, and/or made from preformed plastic, molded plastic, and the like.

Figure 3A:
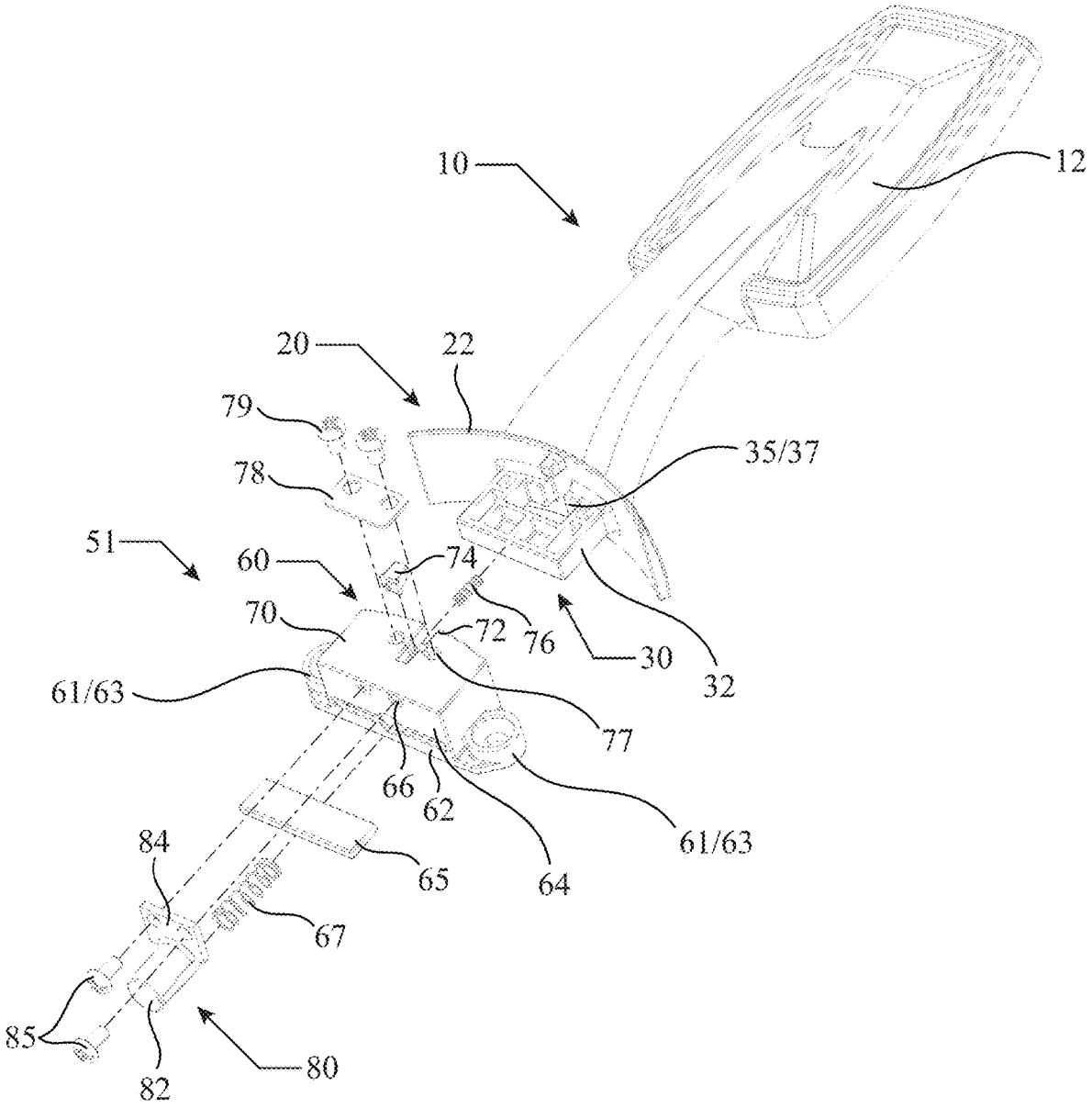
FIG. 3A is a top perspective view of the fan blade arm of the preceding FIGURES and an exploded view of the receiver bracket of FIGS. 1A-1B.
Figure 3B:
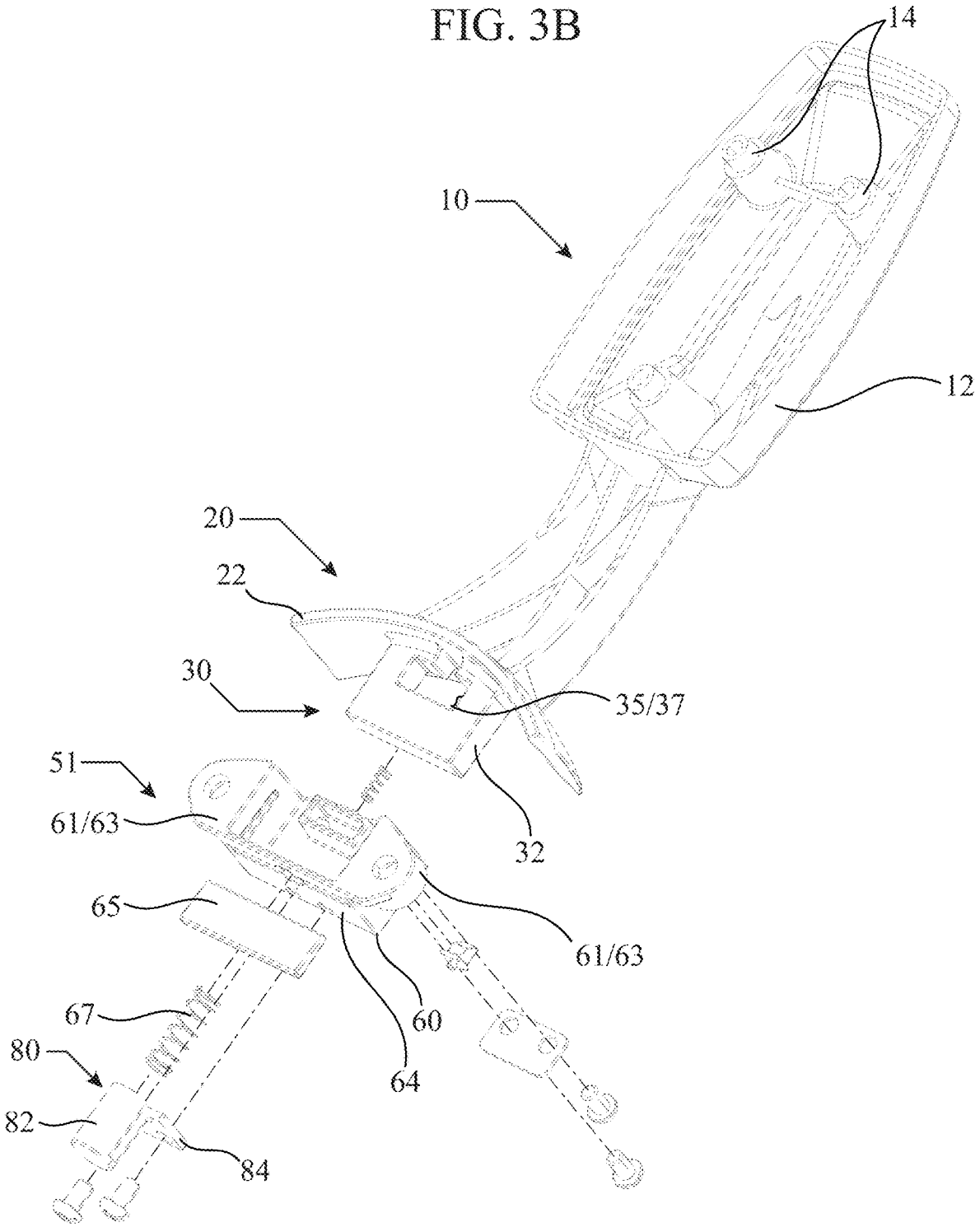
FIG. 3B is a lower perspective view of the fan blade arm and exploded view of the receiver bracket of FIG. 3A.

FIG. 3A is a top perspective vie of the fan blade arm 10 of the preceding FIGURES and an exploded view 51 of the receiver bracket 50 of FIGS. 1A-1B. FIG. 3B is a lower perspective view of the fan blade arm 10 and exploded view 51 of the receiver bracket 50 of FIG. 3A.

Figure 4A:
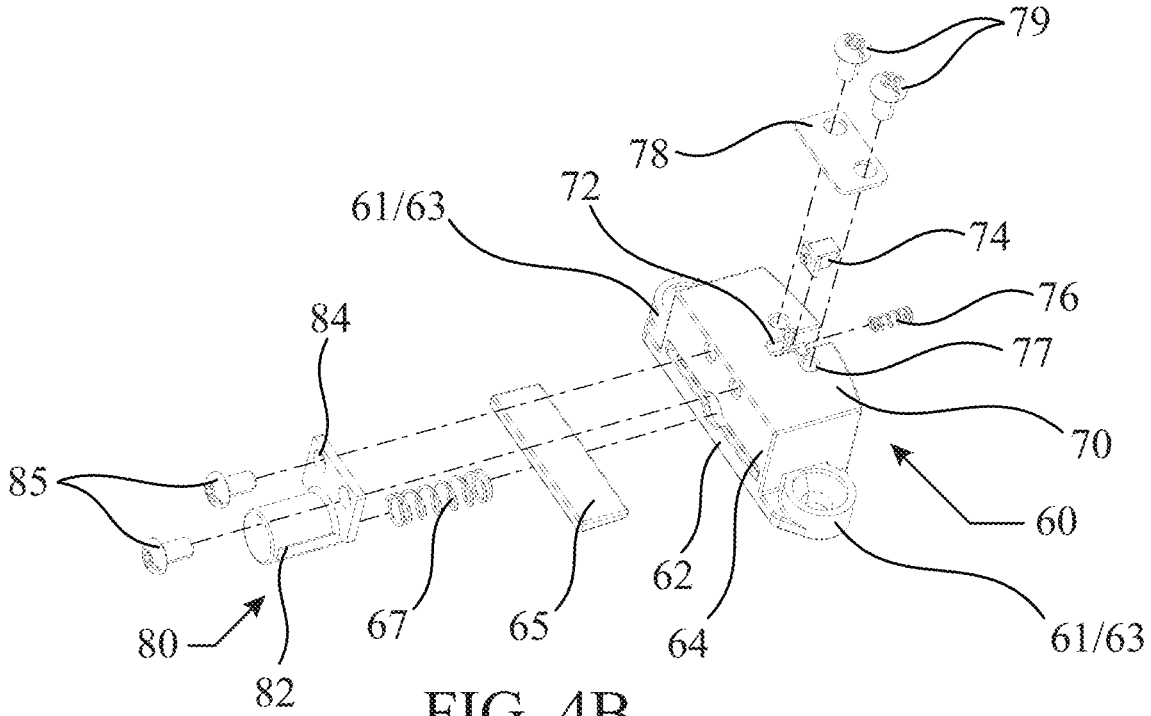
FIG. 4A is an exploded top perspective view of the receiver bracket of FIG. 3A.
Figure 4B:
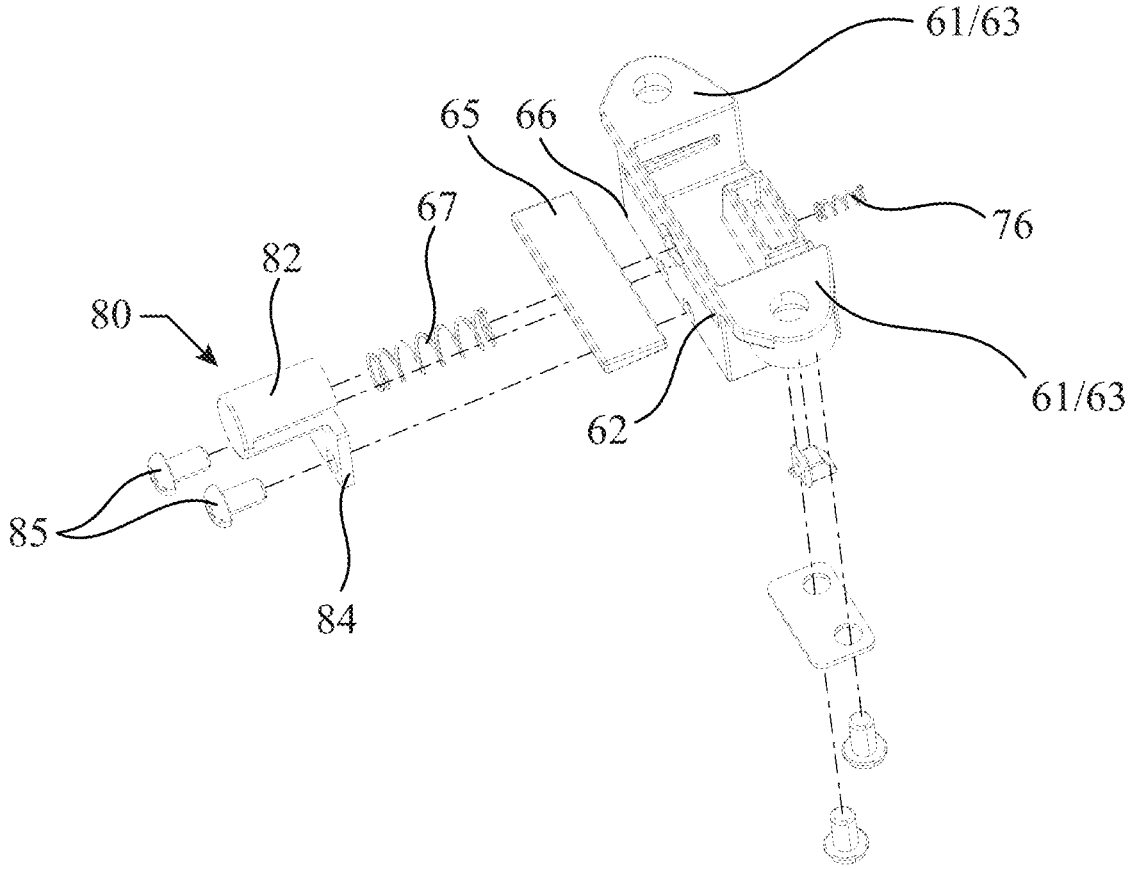
FIG. 4B is an exploded lower perspective view of the receiver bracket of FIG. 3B.

FIG. 4A is an exploded top perspective view of the receiver bracket 51 of FIG. 3A. FIG. 4B is an exploded lower perspective view of the receiver bracket 51 of FIG. 3B.

Referring to FIGS. 3A-4B, the exploded receiver bracket 51 includes a receiver box 60 with side mounting tabs 61/63 for mounting the assembled receiver box 50 to the base/bottom of the motor/rotor, which is shown later.

A slit opening 62 in the receiver box 60 allows for a slidable horizontal table/panel 65 to be inserted therein. A main spring 67 located inside of a closed end of a hollow cylinder 82 has an opposite end with the spring 67 biased against a side edge of the slidable horizontal table/panel 65. A cap cover 80 for holding the main spring 67 is mounted to an outer wall 64 of the receiver box 60 by a mounting tab 84 with through-holes. And screws 85 mount the cap cover 80 to screw holes 66 in the wall 64 of the receiver box.

A top side 70 of the receiver box 60 can include a vertical top opening 72 to receive a spring biased moveable enlarged head catch member stud 74 with a wedge-shaped front end. A small spring 76 which biases against the enlarged head catch member stud 74. A cover plate 78 held in place by screws 79 threaded to threaded openings in the top side 70 of the receiver box 60.

Figure 5A:
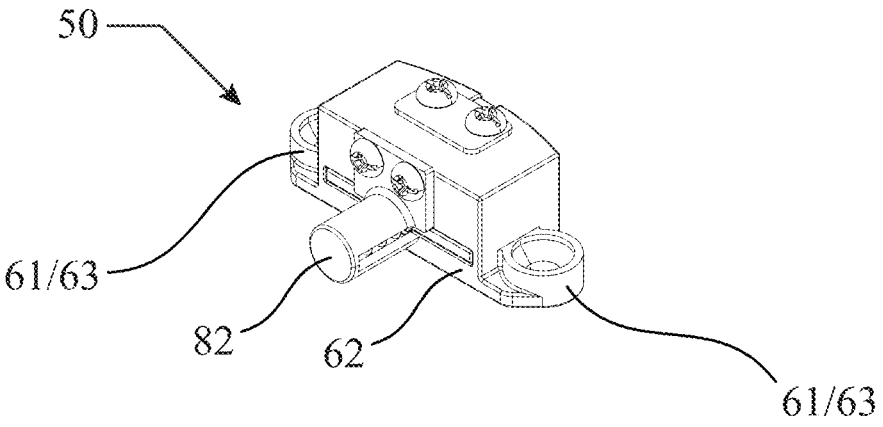
FIG. 5A is a top assembled perspective view of the receiver bracket of FIGS. 3A and 3B and 4A and 4B.
Figure 5B:
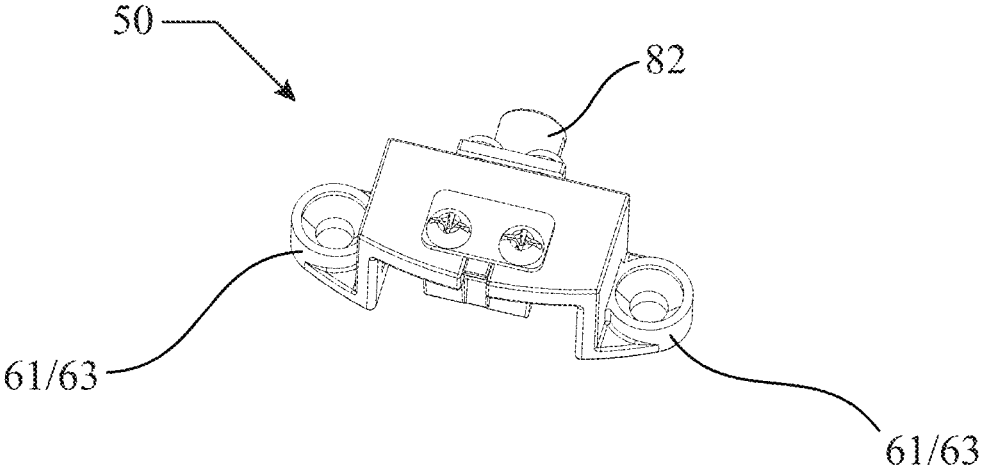
FIG. 5B is another top assembled perspective view of the receiver bracket of FIG. 5A.
Figure 5C:
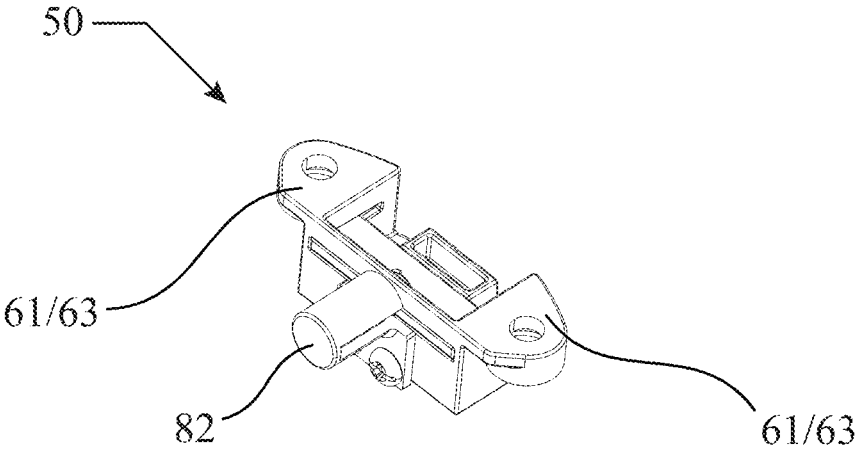
FIG. 5C is a lower perspective view of the assembled receiver bracket of FIG. 5A.

FIG. 5A is a top assembled perspective view of the receiver bracket 50 of FIGS. 3A, 3B, 4A and 4B. FIG. 5B is another top assembled perspective view of the receiver bracket 50 of FIG. 5A. FIG. 5C is a lower perspective view of the assembled receiver bracket 50 of FIG. 5A.

Figure 6A:
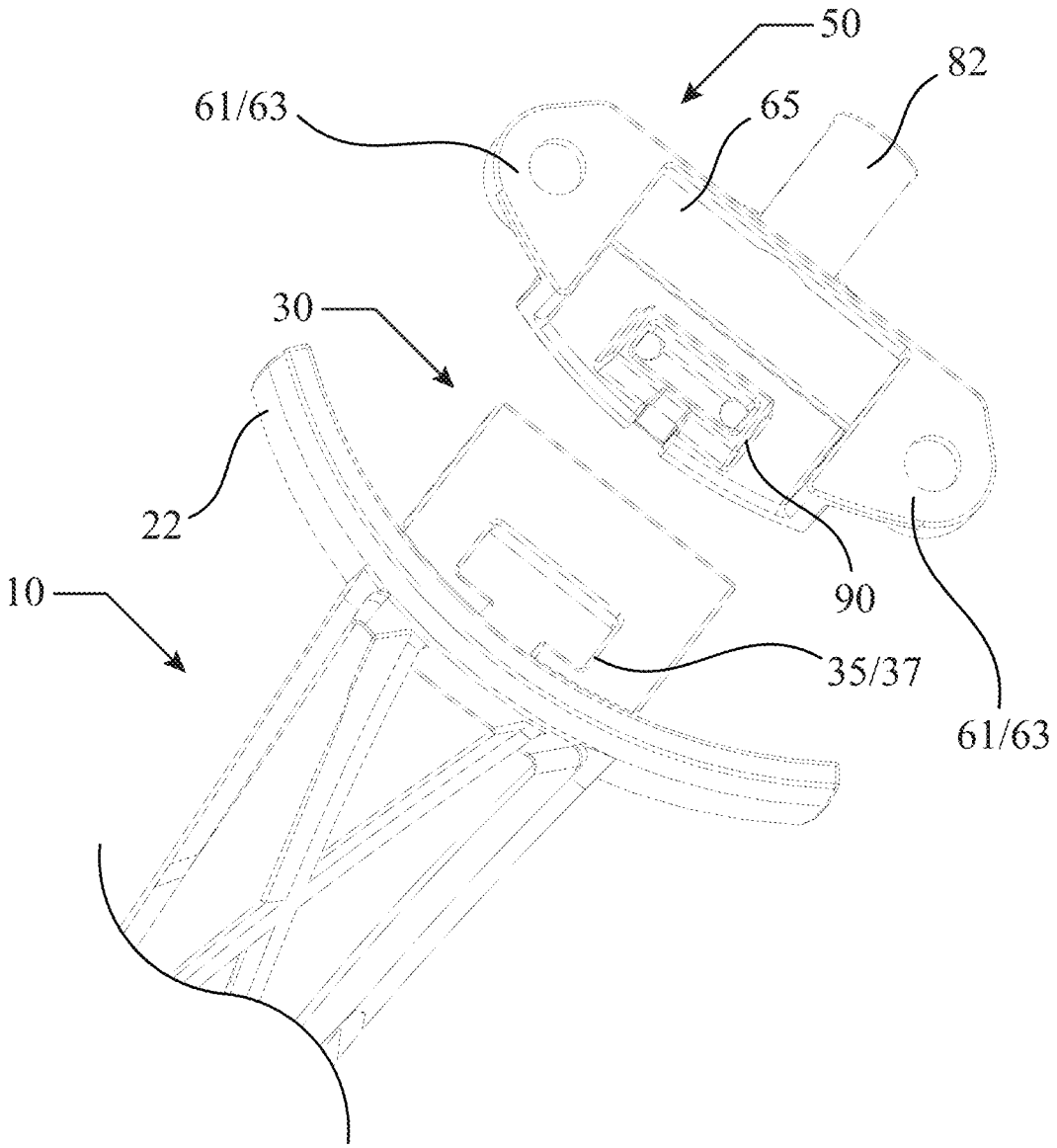
FIG. 6A is a lower perspective view of the protruding rectangular member on the blade arm about to be inserted into the assembled receiver bracket shown in FIGS. 5A and 5B and 5C and 6A.

FIG. 6A is a lower perspective view of the protruding rectangular member 30 on the blade arm 10 about to be inserted into the assembled receiver bracket 50 shown in FIGS. 5A, 5B, 5C and 6A.

Figure 6B:
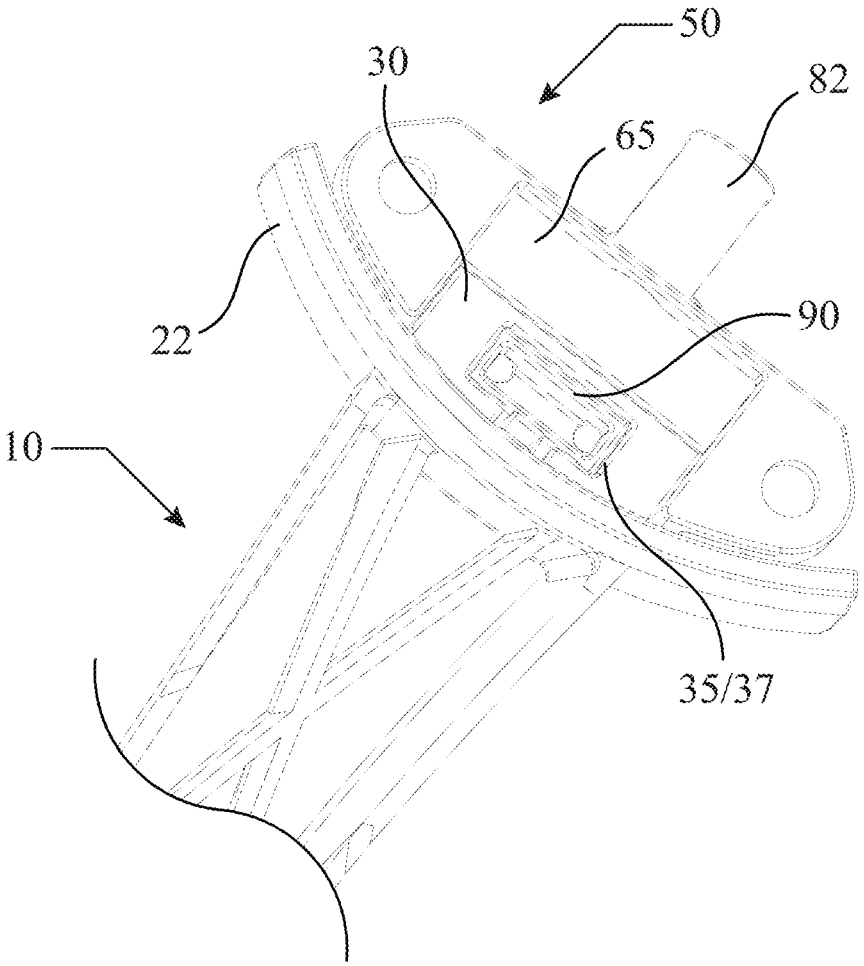
FIG. 6B is a perspective view of FIG. 6A with the protruding rectangular member on the blade arm having been inserted into the assembled receiver bracket, with the protruding member 30 starting to abut against the slideable horizontal table/panel 65, while the T-shaped cutout 35/37 of the protruding member 30 is being latched over and about the raised latch compartment 90 inside of the assembled receiver bracket 50.

FIG. 6B is a perspective view of FIG. 6A with the protruding rectangular member 30 on the blade arm 1 having been inserted into the assembled receiver bracket 50 with the protruding member 30 starting to abut against the slideable horizontal table/panel 65, while the T-shaped cutout 35/37 of the protruding member 30 is being latched over and about the raised latch compartment 90 inside of the assembled receiver bracket 50.

Figure 6C:
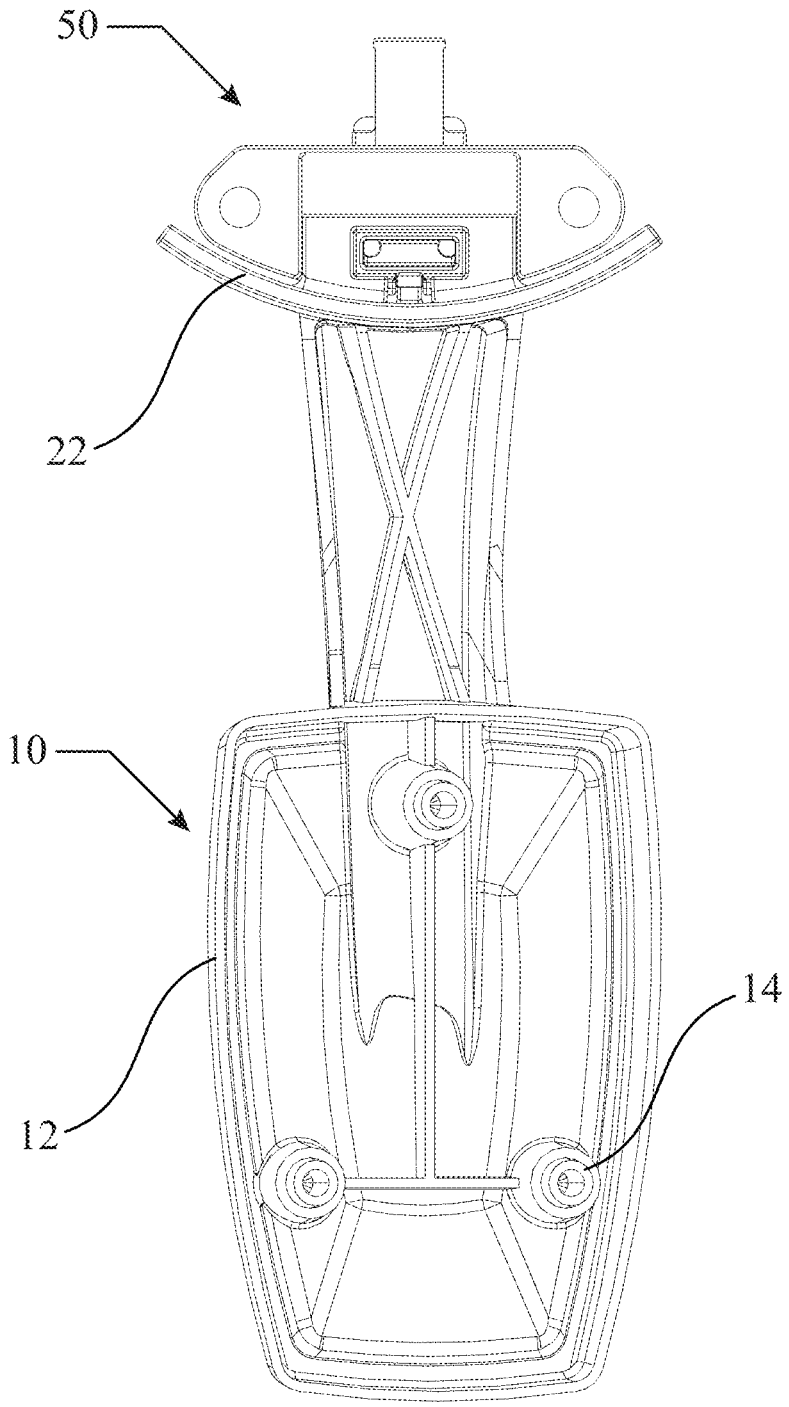
FIG. 6C is a non-perspective view of FIG. 8A.
Figure 8A:
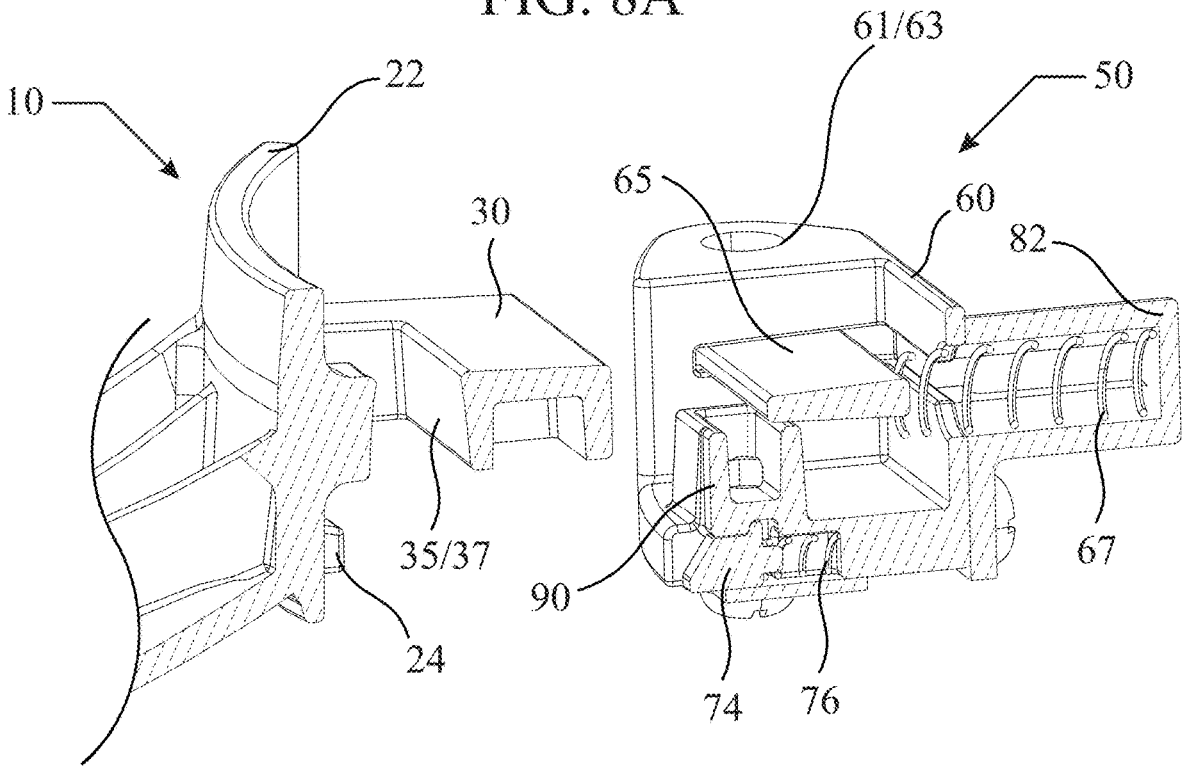
FIG. 8A is a cross-sectional view of the protruding rectangular member on the blade arm about to inserted into the assembled receiver bracket of FIG. 6A, and FIG. 7A.

FIG. 6C is a non-perspective view of FIG. 8A.

Referring to FIGS. 6A-6B, the outer end of the protruding rectangular member 30 is pushed against an exposed outer edge of the slidable horizontal table/panel 65 so that ends of the table/panel slide within opposing channels, and the opposite edge of the table/panel 65 presses against the main spring 67, and the T-shaped cut-out 35/37 in the protruding member 30 is placed over the raised latch compartment 90 inside the assembled receiver bracket 50.

Figure 7C:
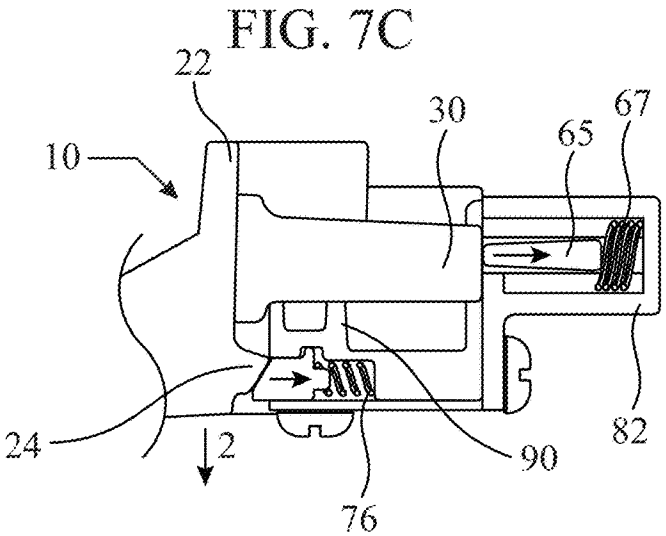
FIG. 7C shows another partial cross-sectional view of the protruding member on the blade arm in FIG. 7B being moved downward with the internal T-shaped cut-out shown in FIG. 6B placed over and about the raised latch compartment 90 in the receiver box.
Figure 7A:
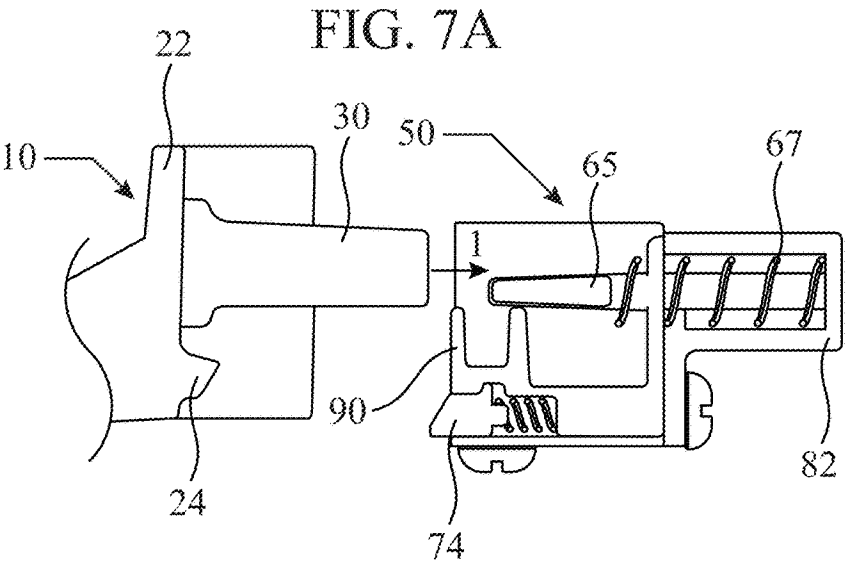
FIG. 7A is a partial side cross-sectional view of the protruding rectangular member on the blade arm about to be inserted into a side cross-sectional view of the assembled receiver bracket as shown in FIG. 6B.

FIG. 7A is a partial side cross-sectional view of the protruding rectangular member 30 on the blade arm 10 about to be inserted into a side cross-sectional view of the assembled receiver bracket 50 as shown in FIG. 6B.

Figure 7D:
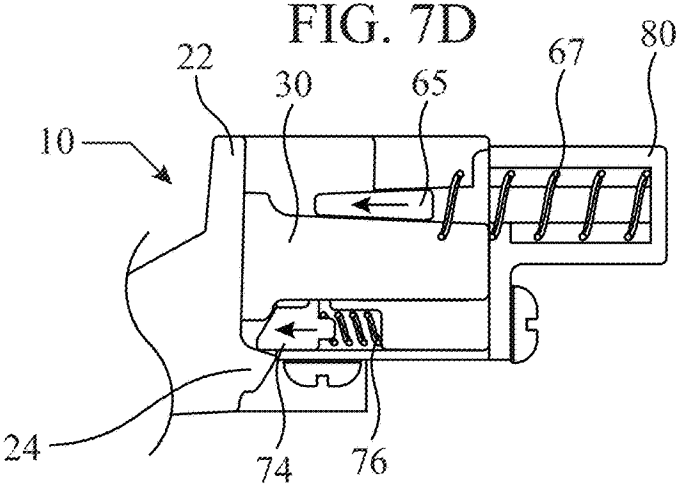
FIG. 7D shows another partial cross-sectional view of FIG. 7C with the protruding member 30 now low enough so that the slidable horizontal table/panel 65 is now pushed by the compressed spring 80 to slide over the protruding member 30, where the small spring 76 biases the enlarged head catch member 74 with wedge shaped front end to be wedged in place by the fixed protruding stud 24 on the curved flange member 22 of the blade arm 10.
Figure 7B:
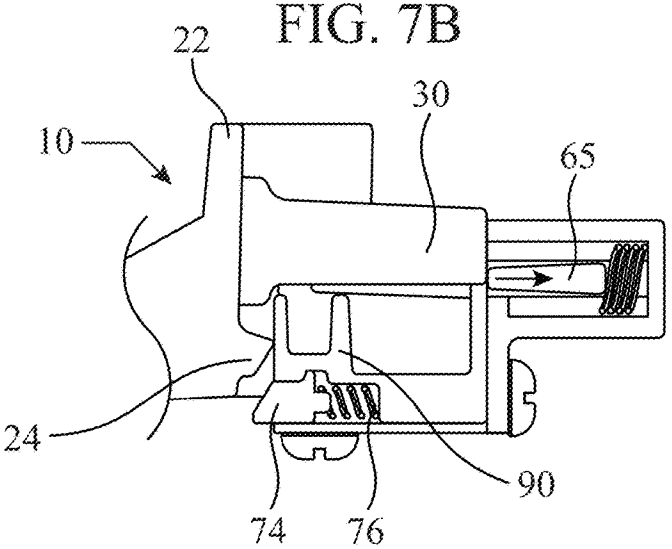
FIG. 7B shows another partial cross-sectional view of the protruding member on the blade arm pushing against the slidable horizontal panel pushing against the main spring inside the cap cover.

FIG. 7B shows another partial cross-sectional view of the protruding member 30 on the blade arm 10 pushing against the slidable horizontal table/panel 65 pushing against the main spring 67 inside the cap cover 82.

FIG. 7C shows another partial cross-sectional view of the protruding member 30 on the blade arm 10 in FIG. 7B being moved downward with the internal T-shaped cut-out 35/37 shown in FIG. 6B placed over and about the raised latch compartment 90 in the assembled receiver box 50.

FIG. 7D shows another partial cross-sectional view of FIG. 7C with the protruding member 30 now low enough so that the slidable horizontal table/panel 65 is pushed by the compressed spring 80 to slide over the protruding member 30, latching the blade arm 10 to the assembled receiver bracket 50, which forms a first latch mechanism. At the same time the small spring 76 biases the enlarged head catch member 74 with wedge shaped front end to be wedged in place above and by the fixed protruding stud 24 on the curved flange member 22 of the blade arm 10 forming a second latch mechanism to keep the blade arm 10 latched to the assembled receiver bracket 50, which forms a second latch mechanism.

FIG. 8A is a cross-sectional view of the protruding rectangular member 30 on the blade arm 10 about to inserted into the assembled receiver bracket 50 of FIG. 6A, and FIG. 7A.

Figure 8B:
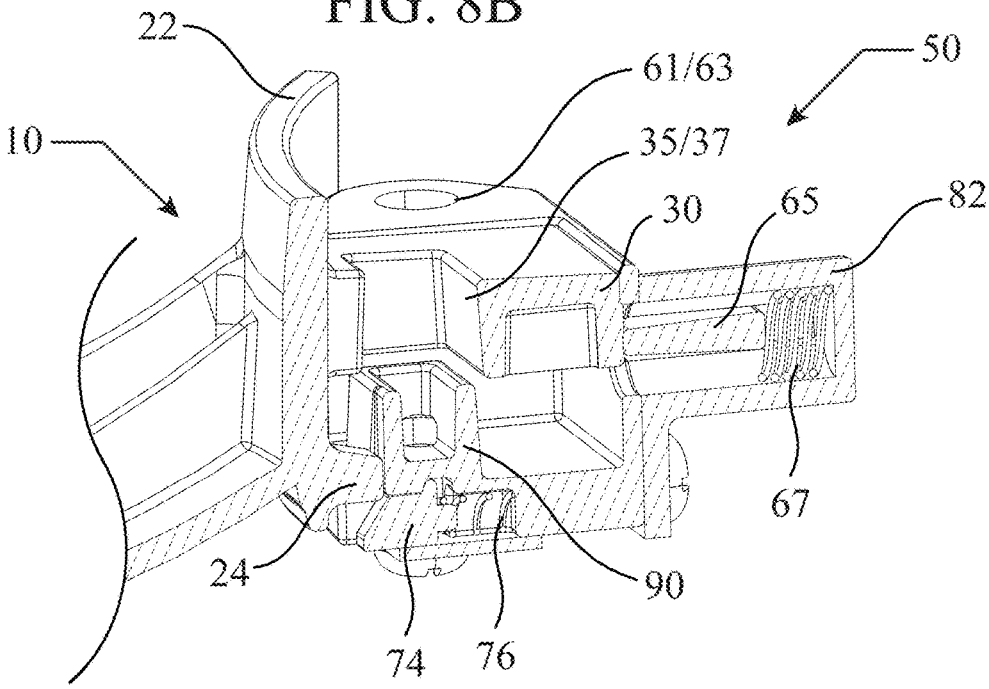
FIG. 8B is a cross-sectional view of the protruding member on the blade arm pushing against the slidable horizontal table/panel compressing the main spring inside the assembled receiver bracket, shown in FIG. 7B.

FIG. 8B is a cross-sectional view of the protruding member 30 on the blade arm 10 pushing against the slidable horizontal table/panel 65 compressing the main spring 67 inside the closed end hollow cylinder 82 of the cap cover 80 of the assembled receiver bracket 50, shown in FIG. 7B.

Figure 8C:
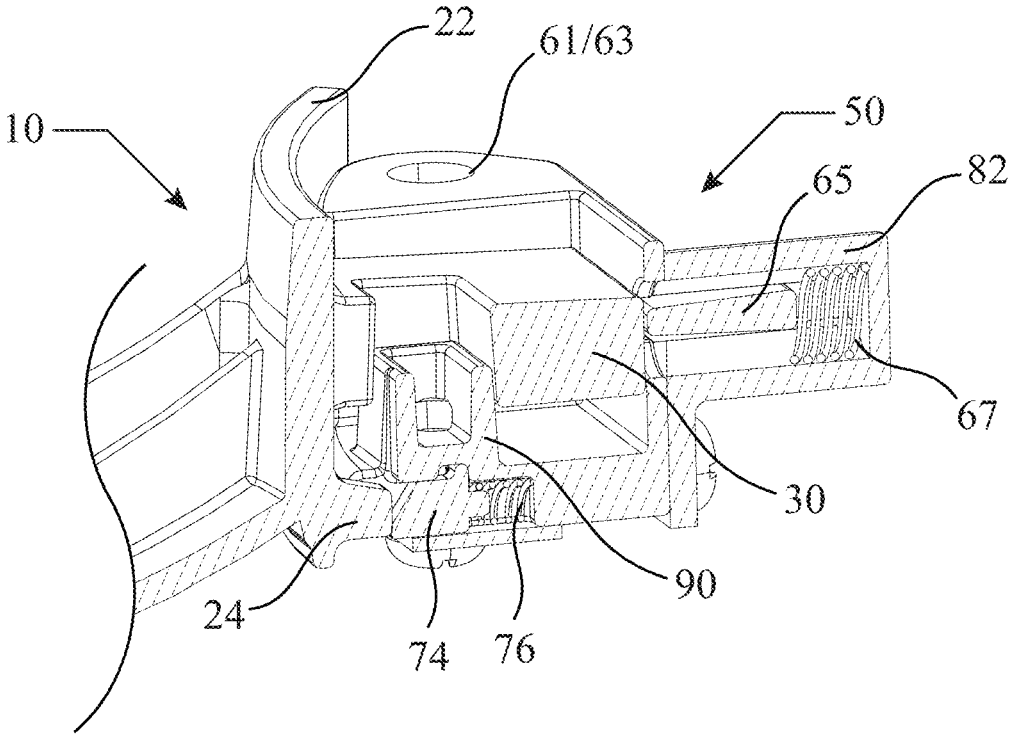
FIG. 8C is a cross-sectional view of the protruding member on the blade arm being moved downward in the receiver bracket shown in FIG. 7C.

FIG. 8C is a cross-sectional view of the protruding member 30 on the blade arm 10 being moved downward inside the assembled receiver bracket 50 shown in FIG. 7C.

Figure 8D:
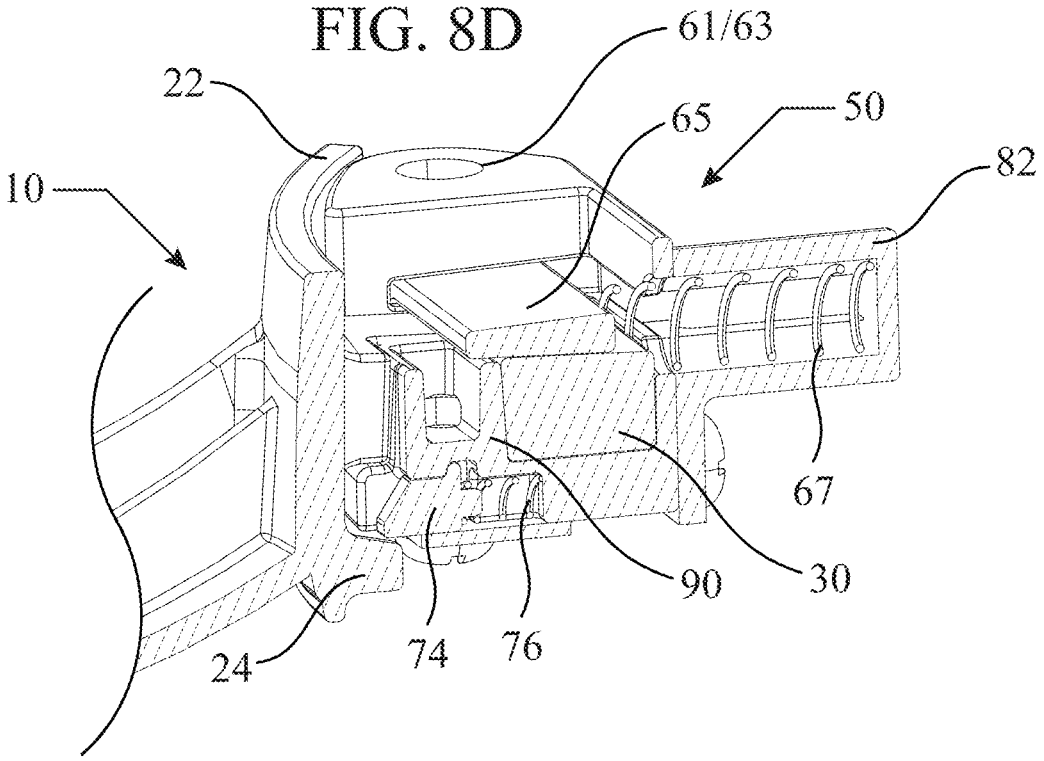
FIG. 8D is a cross-sectional view of the protruding member on the blade arm having been moved downward so that the slidable horizontal table/panel has been slid back by the main spring to lay over the protruding member on the blade arm, shown in FIG. 7D.

FIG. 8D is a cross-sectional view of the protruding member 30 on the blade arm 10 having been moved downward so that the slidable horizontal table/panel 65 has been slid back by the expanding main spring 67 to lay over the protruding member 30 on the blade arm 10, shown in FIG. 7D, which forms a first latch mechanism. At the same time the small spring 76 biases the enlarged head catch member 74 with wedge shaped front end to be wedged in place above and by the fixed protruding stud 24 on the curved flange member 22 of the blade arm 10 forming a second latch mechanism to keep the blade arm 10 latched to the assembled receiver bracket 50, which forms a second latch mechanism.

Figure 9A:
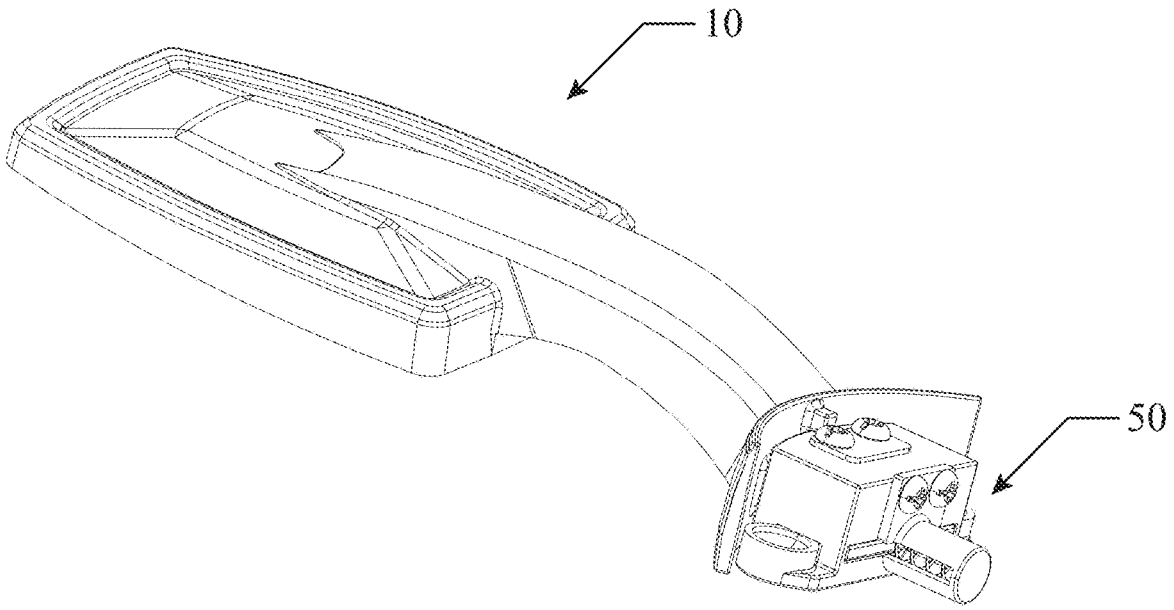
FIG. 9A is an upper left perspective view of a blade arm attached to an assembled receiver bracket.

FIG. 9A is an upper left perspective view of a blade arm 10 attached to an assembled receiver bracket 50 of the preceding FIGURES.

Figure 9B:
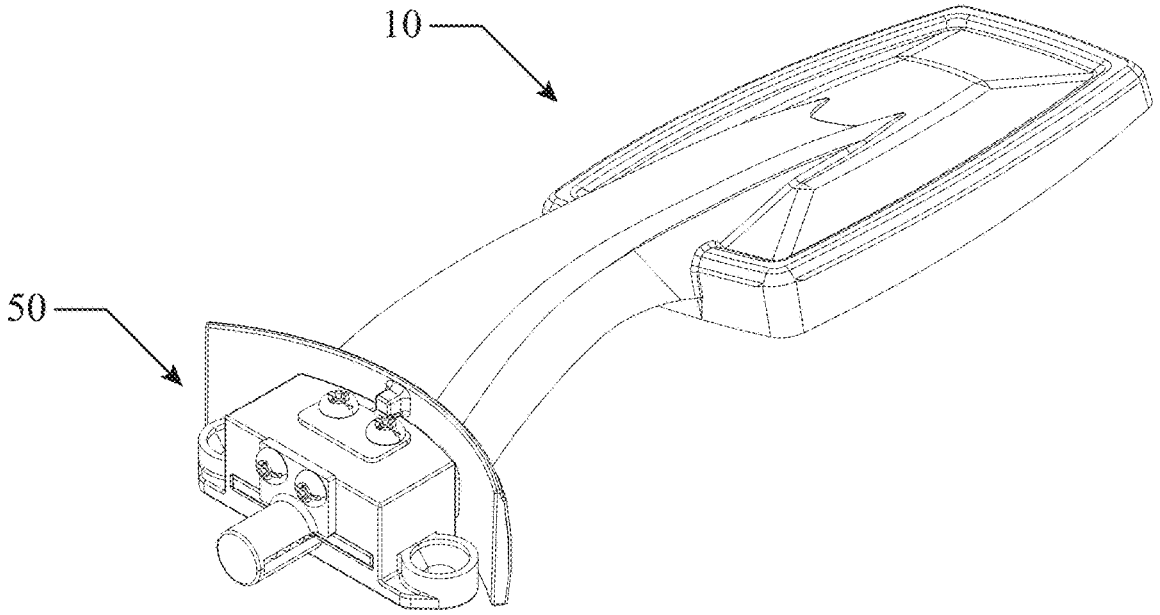
FIG. 9B is an upper right perspective view of a blade arm attached to an assembled receiver bracket of FIG. 9A.
Figure 9C:
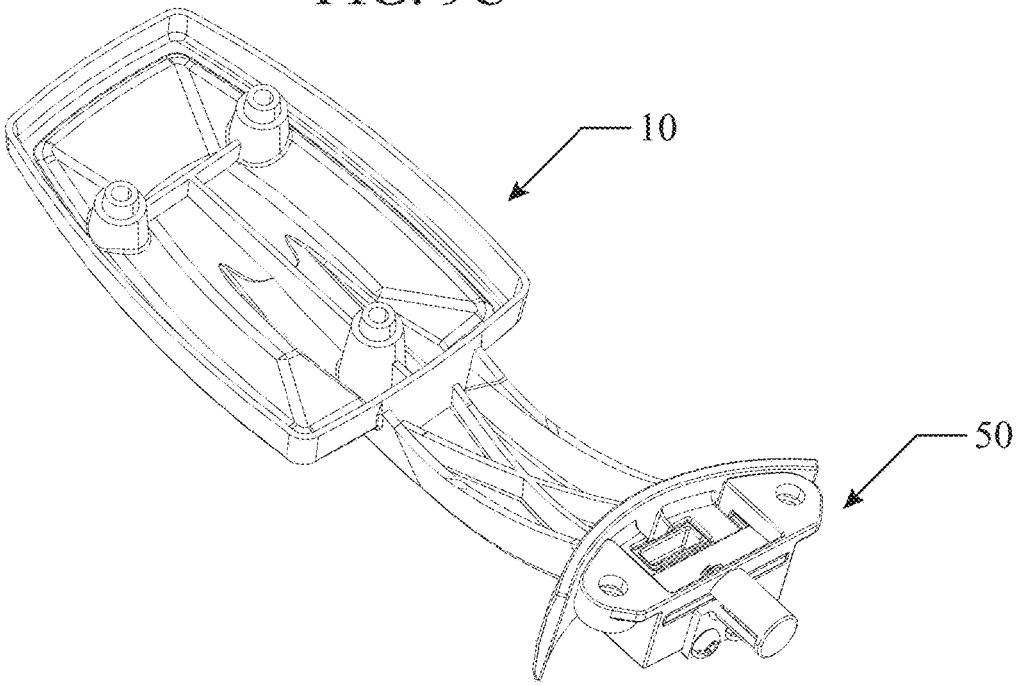
FIG. 9C is a lower perspective view of FIG. 9A.
Figure 9D:
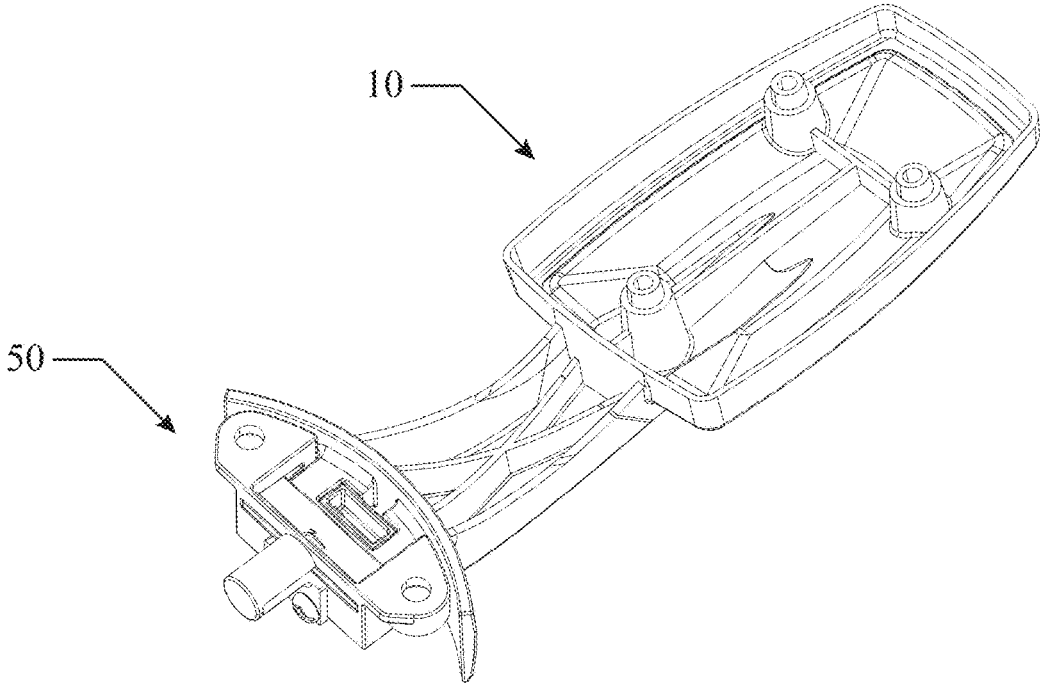
FIG. 9D is a lower perspective view of FIG. 9B.

FIG. 9B is an upper right perspective view of a blade arm 10 attached to an assembled receiver bracket 50 of FIG. 9A. FIG. 9C is a lower perspective view of FIG. 9A. FIG. 9D is a lower perspective view of FIG. 9B.

Figure 10A:
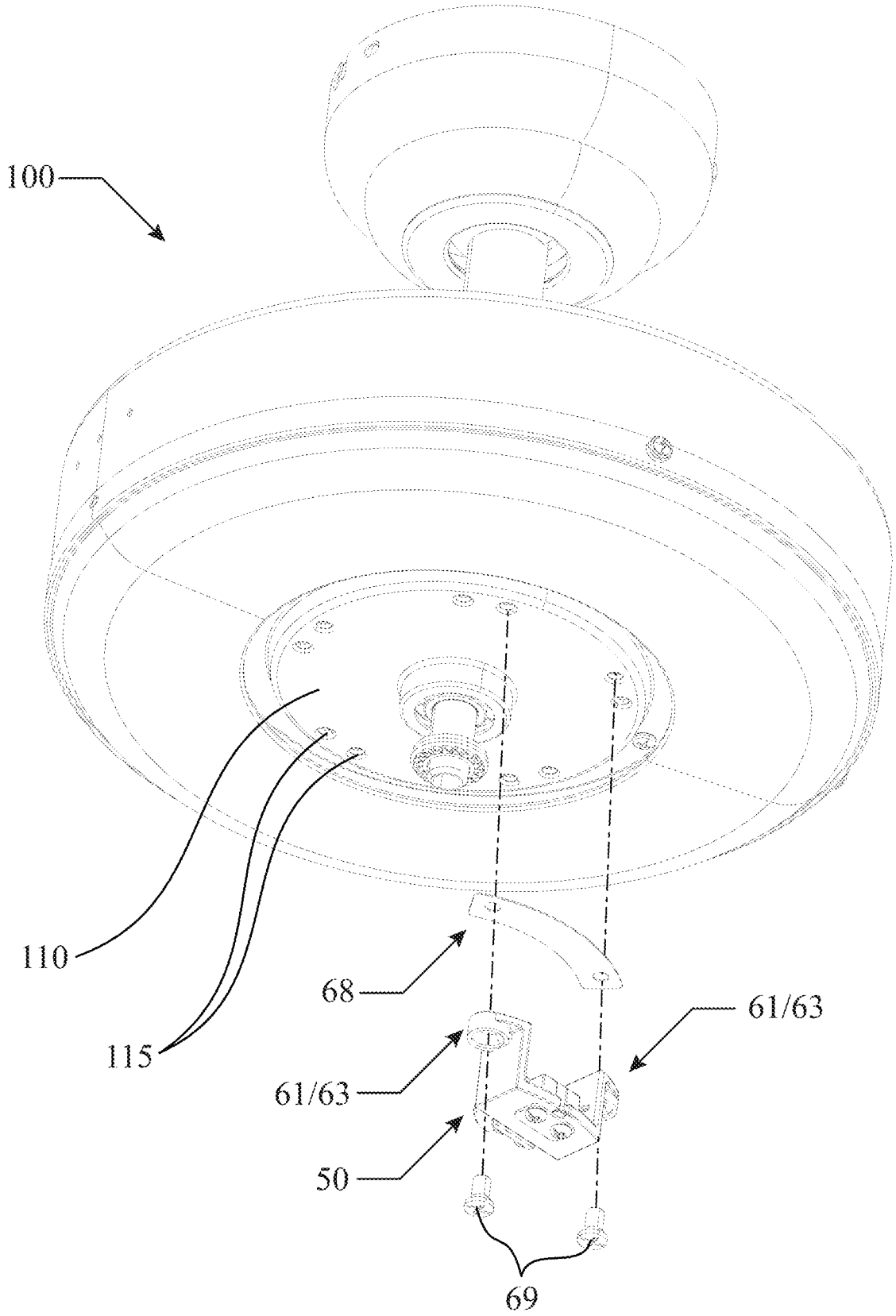
FIG. 10A is a perspective view of ceiling mounted ceiling fan motor with the underside mounting surface on the motor/rotor exposed, with one assembled receiver bracket of the preceding FIGURES about to mounted.

FIG. 10A is a perspective view of ceiling mounted ceiling fan motor and ceiling mount canopy 100 with the underside mounting surface 110 on the motor/rotor exposed, with one assembled receiver bracket 50 of the preceding FIGURES about to mounted.

Figure 10B:
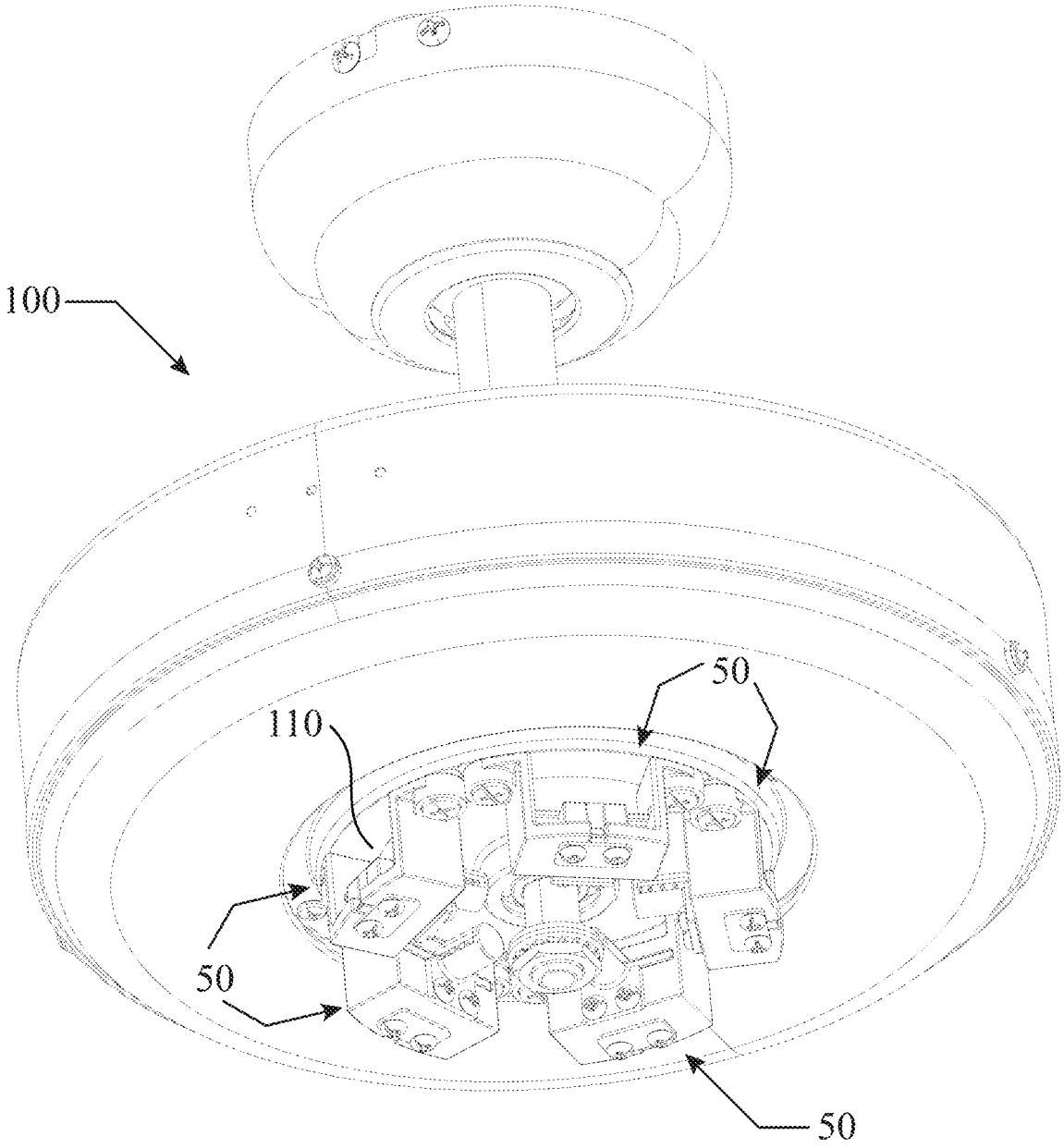
FIG. 10B is another perspective view of FIG. 10A with five assembled receiver brackets mounted to the underside mounting surface of the ceiling fan motor/rotor.

FIG. 10B is another perspective view of FIG. 10A with five assembled receiver brackets 50 mounted to the underside mounting surface 110 of the ceiling fan motor/rotor.

Figure 11A:
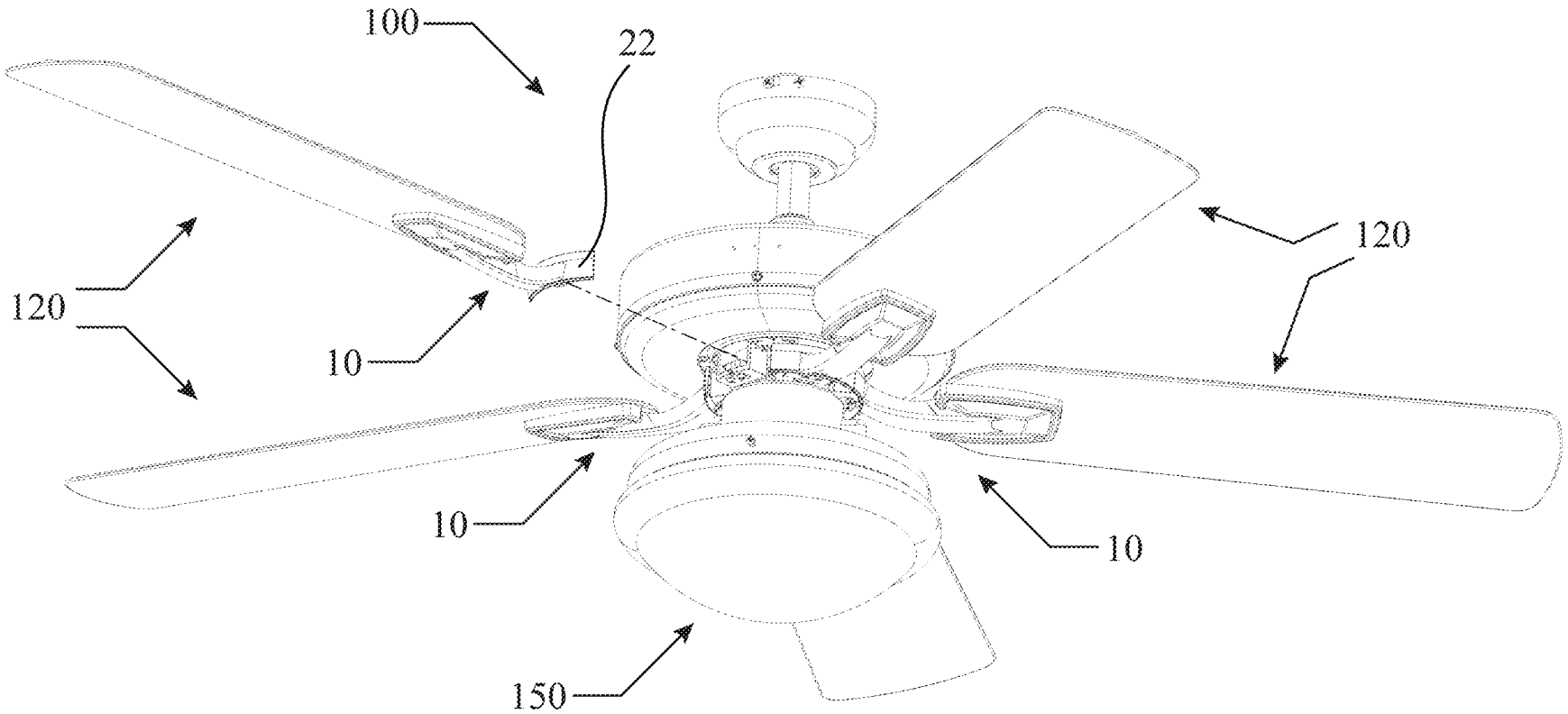
FIG. 11A is a lower side perspective view of a ceiling fan with four blade arms with four ceiling fan blades mounted to four mounted receiver brackets, and a fifth blade arm with blade about to be attached to an assembled receiver bracket mounted to the underside of the motor/rotor.

FIG. 11A is a lower side perspective view of a ceiling fan motor with ceiling mount canopy with four blade arms 10 with four ceiling fan blades 120 mounted to four mounted receiver brackets 50, and a fifth blade arm with blade about to be attached to an assembled receiver bracket mounted to the underside of the motor/rotor. FIG. 11A shows the curved flange member(s) 22 of the blade arms 10 form a decorative ring/rim which hides the assembled receiver brackets 50 from view. In FIG. 11A, a light kit 150 is shown attached to the motor/rotor.

Figure 11B:
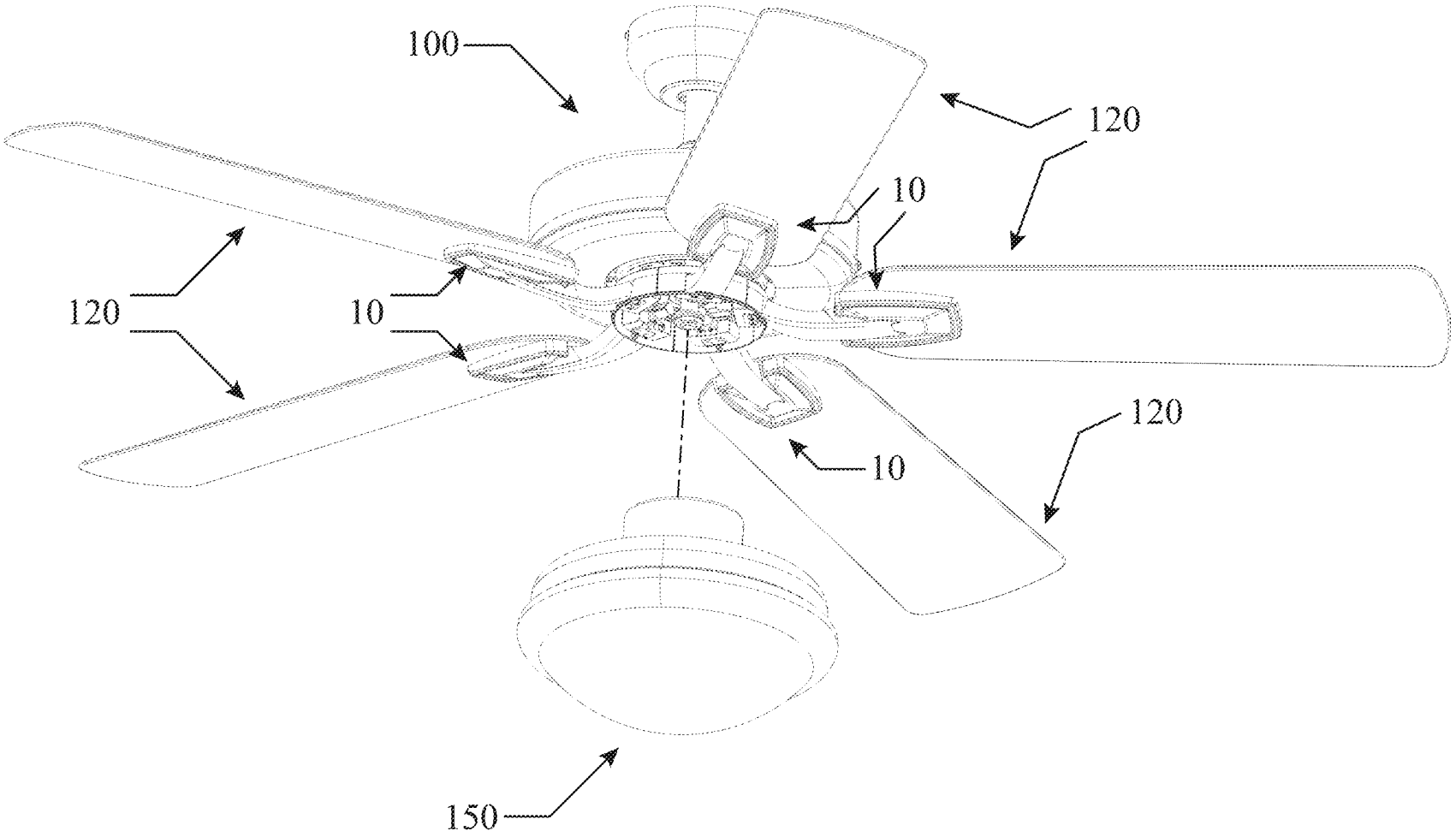
FIG. 11B is another perspective view of FIG. 11A with five blade arms with fan blades mounted to five assembled receiver brackets mounted to the underside of the motor/rotor, with the light kit spaced below the fan.
Figure 11C:
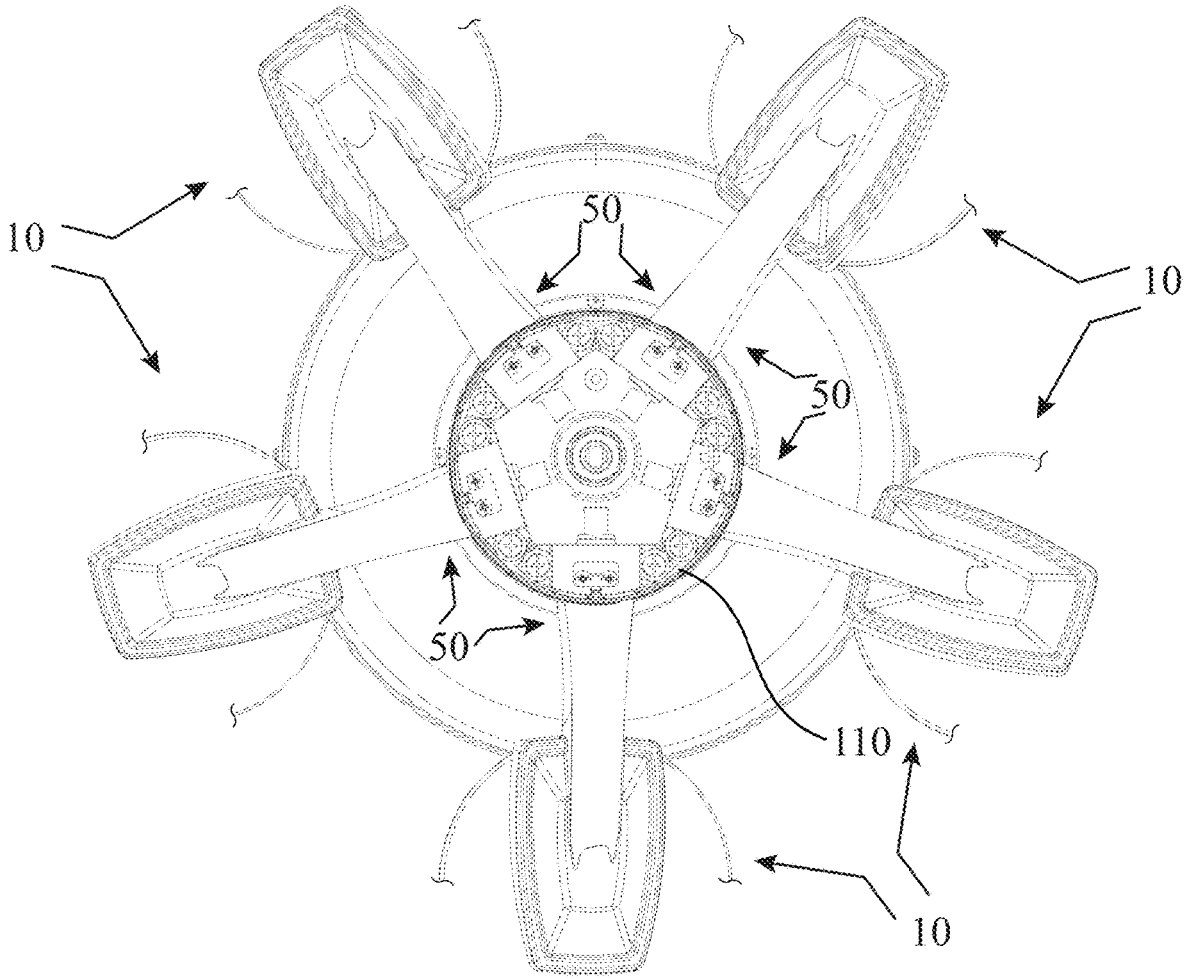
FIG. 11C is an underside perspective view of the five blade arms with blades mounted to the motor/rotor of FIG. 11B, without the light kit.

FIG. 11B is another perspective view of FIG. 11A with five blade arms 10 with fan blades 120 mounted to five assembled receiver brackets 50 mounted to the underside of the motor/rotor, with the light kit 150 spaced below the fan. FIG. 11C is an underside perspective view of the five blade arms 10 mounted to the motor/rotor of FIG. 11B, without the light kit. 150.

The invention can be practiced with only the first latch mechanisms of using the spring biased horizontal table/panel and biased spring where the end of the blade arm is placed over the raised latch compartment and the horizontal table/panel slides backward over the blade arm end. So, the invention will not always require the second latch mechanism of the small spring biased enlarged head catch member stud in some applications.

Although a preferred embodiment shows five (5) assembled receiver brackets 50 being used, each with associated blade arms, and blades, less than five assembled receiver brackets can be mounted. For example, four assembled receiver brackets with associated blade arms and blades, three assembled receiver brackets with associated blade arms and blades, and only two assembled receiver brackets with associated blade arms and blades can also be used when practicing the invention.

While a preferred embodiment shows a base/bottom of the motor/rotor with mounting holes for the assembled receiver brackets, the invention can be practiced by having mounting holes on top of the motor/rotor so that the assembled receiver brackets can be placed on top of the motor/rotor with the blade arms and blades extending outward from above the motor/rotor. The light kit can still remain below the motor/rotor, while the assembled receivers are mounted above the motor/rotor.

In order to change out the blade arm and/or the blade, the invention can be disassembled while reversing the assembly steps referenced above.

Although specific advantages have been enumerated above, various embodiments may include some, none, or all of the enumerated advantages.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S. C. 112(f) unless the words "means for" or "step for" are explicitly used in the particular claim.

The term "approximately" is similar to the term "about" and can be +/−10% of the amount referenced. Additionally, preferred amounts and ranges can include the amounts and ranges referenced without the prefix of being approximately.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A ceiling fan blade arm attachment system, comprising:

a receiver bracket mounted to a ceiling fan motor rotor, the bracket having a chamber with a spring biased ledge member above a catch basin with a catch member, wherein the ledge member has a first position covering the catch basin, and a second position ever exposing the catch member; and a ceiling fan blade iron having an outwardly protruding end with a vertical slot, wherein pushing the protruding end into the chamber against the spring biased ledge member exposes the catch basin to the vertical slot, and lowering the vertical slot over the catch member in the catch basin, allows the ledge member to move backward over the protruding end of the blade arm locking the blade arm to the motor rotor.

2. The ceiling fan blade arm attachment system of claim 1, wherein the ledge member includes a horizontal panel.

3. The ceiling fan blade arm attachment system of claim 1, further comprising:

a spring biased latch member beneath the bracket, wherein the spring biased latch member is pushed inward when the protruding end of the blade arm is being inserted into the chamber, and expands outward into a gap under the ceiling fan blade iron after the protruding end is fully pushed into the chamber, locking the ceiling fan blade arm to the motor rotor.

4. The ceiling fan blade arm attachment system of claim 1, further comprising:

a pair of side tabs on the bracket for mounting the bracket to the ceiling fan motor rotor; and fasteners selected from screws and bolts to fasten each of the side tabs to the ceiling fan motor rotor.

5. A ceiling fan blade arm attachment system, comprising:

a receiver bracket mounted to a ceiling fan motor rotor, the bracket having a chamber with a spring biased panel above a catch basin with a catch compartment, wherein the spring biased panel has a first position covering the catch compartment, and a second position exposing the catch compartment; and a ceiling fan blade iron having an outwardly protruding end with a vertical slot, wherein pushing the protruding end into the chamber against the spring biased panel exposes the catch compartment to the vertical slot, and lowering the vertical slot over the catch compartment in the catch basin, allows the spring biased panel to move backward over the protruding end of the blade arm locking the blade arm to the motor rotor.

6. The ceiling fan blade arm attachment system of claim 5, wherein the spring biased panel includes a horizontal panel.

7. The ceiling fan blade arm attachment system of claim 5, further comprising:

a spring biased latch member beneath the bracket, wherein the spring biased latch member is pushed inward when the protruding end of the blade arm is being inserted into the chamber, and expands outward into a gap under the ceiling fan blade iron after the protruding end is fully pushed into the chamber, locking the ceiling fan blade arm to the motor rotor.

8. The ceiling fan blade arm attachment system of claim 5, further comprising:

a pair of side tabs on the bracket for mounting the bracket to the ceiling fan motor rotor; and fasteners selected from screws and bolts to fasten each of the side tabs to the ceiling fan motor rotor.

9. A ceiling fan blade arm attachment system, comprising:

a receiver bracket mounted to a ceiling fan motor rotor, the bracket having a chamber with a spring biased slideable ledge above a catch compartment, wherein the slideable ledge has a first position covering the catch compartment, and a second position exposing the catch compartment; and a ceiling fan blade iron having an outwardly protruding end with a vertical slot, wherein pushing the protruding end into the chamber against the spring biased slideable ledge exposes the catch compartment to the vertical slot, and lowering the vertical slot over the catch compartment, allows the slideable ledge to move backward over the protruding end of the blade arm locking the blade arm to the motor rotor.

10. The ceiling fan blade arm attachment system of claim 9, wherein the slideable ledge includes a horizontal panel.

11. The ceiling fan blade arm attachment system of claim 9, further comprising:

a spring biased latch member beneath the bracket, wherein the spring biased latch member is pushed inward when the protruding end of the blade arm is being inserted into the chamber, and expands outward into a gap under the ceiling fan blade iron after the protruding end is fully pushed into the chamber, locking the ceiling fan blade arm to the motor rotor.

12. The ceiling fan blade arm attachment system of claim 9, further comprising:

a pair of side tabs on the bracket for mounting the bracket to the ceiling fan motor rotor; and fasteners selected from screws and bolts to fasten each of the side tabs to the ceiling fan motor rotor.

* * * * *